US009267341B2

(12) United States Patent
Reddy et al.

(10) Patent No.: US 9,267,341 B2
(45) Date of Patent: Feb. 23, 2016

(54) DRILLING RIG EMPLOYING PIVOTING DRILLING TOWER

(71) Applicant: Nabors Drilling International Limited, Hamilton (BM)

(72) Inventors: Padira Reddy, Richmond, TX (US); Ashish Gupta, Houston, TX (US); Sean M. Bailey, Willis, TX (US)

(73) Assignee: Nabors Drilling International Limited, Hamilton (BM)

( * ) Notice: Subject to any disclaimer, the term of this patent is extended or adjusted under 35 U.S.C. 154(b) by 400 days.

(21) Appl. No.: 13/789,168

(22) Filed: Mar. 7, 2013

(65) Prior Publication Data

US 2013/0299189 A1 Nov. 14, 2013

Related U.S. Application Data

(60) Provisional application No. 61/646,686, filed on May 14, 2012.

(51) Int. Cl.

| | |
|---|---|
| ***E21B 19/08*** | (2006.01) |
| ***E21B 19/06*** | (2006.01) |
| ***E21B 15/00*** | (2006.01) |
| ***E21B 3/02*** | (2006.01) |
| ***E21B 19/083*** | (2006.01) |
| ***E21B 19/14*** | (2006.01) |

(52) U.S. Cl.

CPC . *E21B 19/08* (2013.01); *E21B 3/02* (2013.01); *E21B 15/00* (2013.01); *E21B 19/06* (2013.01); *E21B 19/083* (2013.01); *E21B 19/14* (2013.01)

(58) Field of Classification Search

CPC ..... E21B 3/02; E21B 19/08; E21B 19/14; E21B 19/083; E21B 19/00; E21B 19/06

See application file for complete search history.

(56) References Cited

U.S. PATENT DOCUMENTS

| | | | | |
|---|---|---|---|---|
| 2,792,198 | A * | 5/1957 | Braun | 175/5 |
| 3,650,339 | A * | 3/1972 | Selfe et al. | 175/85 |
| 4,203,576 | A | 5/1980 | Sutton | |
| 4,586,572 | A * | 5/1986 | Myers et al. | 175/85 |
| 4,718,805 | A | 1/1988 | Becker | |

(Continued)

FOREIGN PATENT DOCUMENTS

| | | | |
|---|---|---|---|
| EP | 0548900 | A2 | 6/1993 |
| WO | WO 2005/073471 | A1 | 8/2005 |

(Continued)

OTHER PUBLICATIONS

PCT/US2013/039695, "The International Search Report and Written Opinion," Apr. 2, 2014, 9 pages.

*Primary Examiner* — Yong-Suk (Philip) Ro

(74) *Attorney, Agent, or Firm* — Haynes and Boone LLP

(57) ABSTRACT

An apparatus including a base, and a drilling tower pivotally coupled to the base to pivot the drilling tower between first and second pivot positions. The drilling tower includes a first portion, and a second portion pivotally coupled to the first portion to pivot the second portion between third and fourth pivot positions when the drilling tower is in the first pivot position. A method includes pivotally coupling a drilling tower to a base, which includes providing a first portion of the drilling tower, pivotally coupling a second portion of the drilling tower to the first portion of the drilling tower, and pivotally coupling the first portion of the drilling tower to the base.

19 Claims, 15 Drawing Sheets

(56) References Cited

U.S. PATENT DOCUMENTS

| | | | | |
|---|---|---|---|---|
| 4,843,945 | A | 7/1989 | Dinsdale | |
| 5,423,390 | A | 6/1995 | Donnally et al. | |
| 7,134,513 | B1 | 11/2006 | Randall et al. | |
| 7,255,180 | B2 | 8/2007 | Beato et al. | |
| 7,318,491 | B2 | 1/2008 | Riel | |
| 7,347,285 | B2 * | 3/2008 | Hamner | 175/122 |
| 7,744,327 | B2 | 6/2010 | Lops et al. | |
| 7,802,636 | B2 | 9/2010 | Childers et al. | |
| 7,905,300 | B2 | 3/2011 | Rieder et al. | |
| 8,033,345 | B1 | 10/2011 | Randall et al. | |
| 8,046,959 | B2 | 11/2011 | Stoetzer et al. | |
| 8,052,370 | B2 | 11/2011 | Dekker et al. | |
| 8,157,495 | B1 | 4/2012 | Randall | |
| 8,671,626 | B1 | 3/2014 | Marty et al. | |
| 2001/0015274 | A1 | 8/2001 | Gipson | |
| 2005/0241857 | A1 | 11/2005 | Beato et al. | |
| 2005/0279507 | A1 | 12/2005 | Folk et al. | |
| 2008/0053704 | A1 | 3/2008 | Zachariasen et al. | |
| 2008/0251267 | A1 | 10/2008 | Cicognani | |
| 2009/0053015 | A1 | 2/2009 | Zachariasen et al. | |
| 2009/0084537 | A1 | 4/2009 | Rudshaug et al. | |
| 2009/0196712 | A1 | 8/2009 | Mortensen et al. | |
| 2009/0314547 | A1 | 12/2009 | Stoetzer et al. | |
| 2010/0193247 | A1 | 8/2010 | Riddle et al. | |
| 2010/0230166 | A1 | 9/2010 | Sigmar et al. | |
| 2010/0319999 | A1 | 12/2010 | Haughom | |
| 2010/0329823 | A1 | 12/2010 | Baumler et al. | |
| 2011/0148133 | A1 | 6/2011 | Hessels et al. | |
| 2011/0188973 | A1 | 8/2011 | Baumler | |
| 2011/0214917 | A1 | 9/2011 | Boudreaux | |
| 2011/0240371 | A1 | 10/2011 | Murr et al. | |
| 2011/0247290 | A1 | 10/2011 | Beck et al. | |
| 2012/0097454 | A1 | 4/2012 | Kockeis et al. | |
| 2012/0103623 | A1 | 5/2012 | Wijning et al. | |
| 2013/0299190 | A1 | 11/2013 | Reddy et al. | |
| 2013/0299244 | A1 | 11/2013 | Reddy et al. | |
| 2013/0302114 | A1 | 11/2013 | Reddy et al. | |
| 2013/0327543 | A1 | 12/2013 | Reddy et al. | |

FOREIGN PATENT DOCUMENTS

| | | | |
|---|---|---|---|
| WO | WO 2005/073495 | A1 | 8/2005 |
| WO | WO 2005/073497 | A1 | 8/2005 |
| WO | WO 2011/016719 | A1 | 2/2011 |
| WO | WO 2011/120627 | A2 | 10/2011 |
| WO | WO 2012/032384 | A1 | 3/2012 |

* cited by examiner

DRILLING RIG EMPLOYING PIVOTING DRILLING TOWER

CROSS-REFERENCE TO RELATED APPLICATION

This application claims the benefit of and priority to U.S. Provisional Application No. 61/646,686 filed May 14, 2012, entitled "Drilling Rig and Methods," to Reddy et al., the entire disclosure of which is hereby incorporated herein by reference.

BACKGROUND OF THE DISCLOSURE

The present disclosure relates in general to drilling rigs, and in particular to drilling rigs employing top drives, tubular handling devices, pivoting drilling towers, or combinations thereof.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
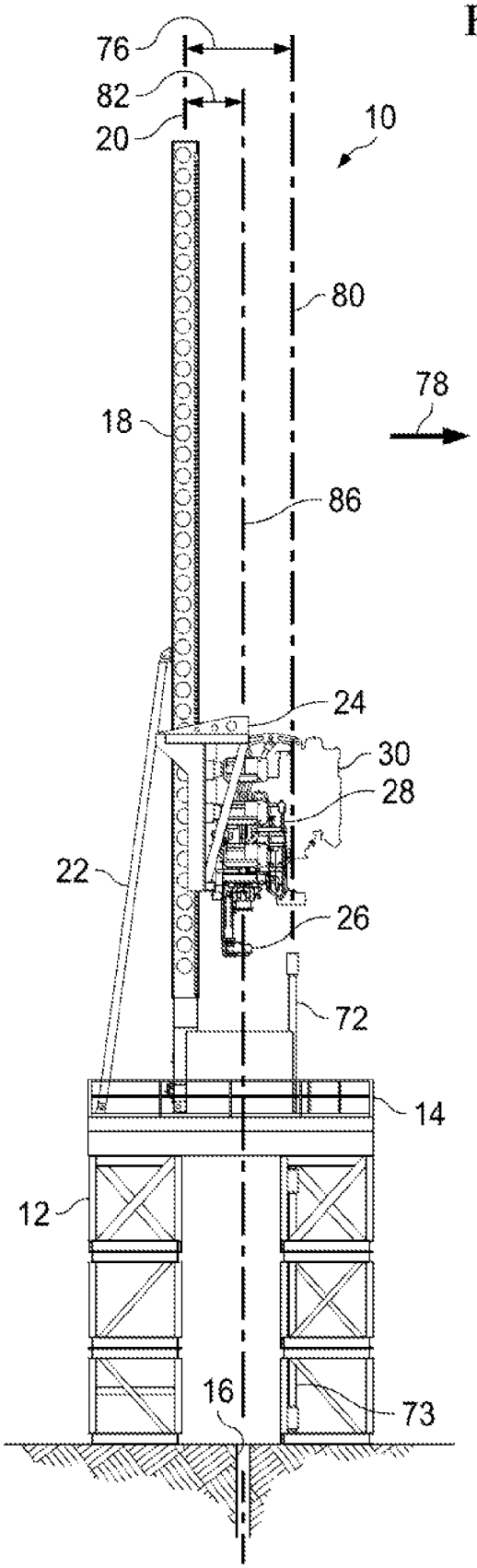
FIG. 1 is a side elevational view of an apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Referring to FIG. 1, illustrated is an elevational view of an apparatus 10. The apparatus 10 may be, include, or be part of, a land-based drilling rig. In several exemplary embodiments, instead of a land-based drilling rig, the apparatus 10 may be, include, or be part of, any type of drilling rig, such as a jack-up rig, a semi-submersible rig, a drill ship, a coil tubing rig, a platform rig, a slant rig, or a casing drilling rig, among others. The apparatus 10 includes a platform 12, which includes a rig floor 14 that is positioned adjacent or above a wellbore 16. In several exemplary embodiments, the platform 12 may be, include, or be a part of, one or more of several types of platforms. A drilling mast or tower 18 is coupled to the platform 12, and extends longitudinally along an axis 20. In one embodiment, the tower 18 is releasably coupled. A support member 22 extends between the platform 12 and the tower 18. A carriage 24 is movably coupled to the tower 18. A top drive 26 is coupled to the carriage 24. The top drive 26 extends longitudinally in a parallel relation to the tower 18. As will be described in further detail below, the carriage 24 and the top drive 26 coupled thereto are movable along the axis 20, relative to the tower 18. As will be described in further detail below, the top drive 26 is movable, relative to the tower 18, between positions 28 and 30, as shown in FIG. 1. In several exemplary embodiments, the apparatus 10 does not include the top drive 26; instead, the apparatus 10 may be, include, or be a part of, another type of drilling rig such as, for example, a rotary-swivel rig or a power-swivel rig.

Figure 2:
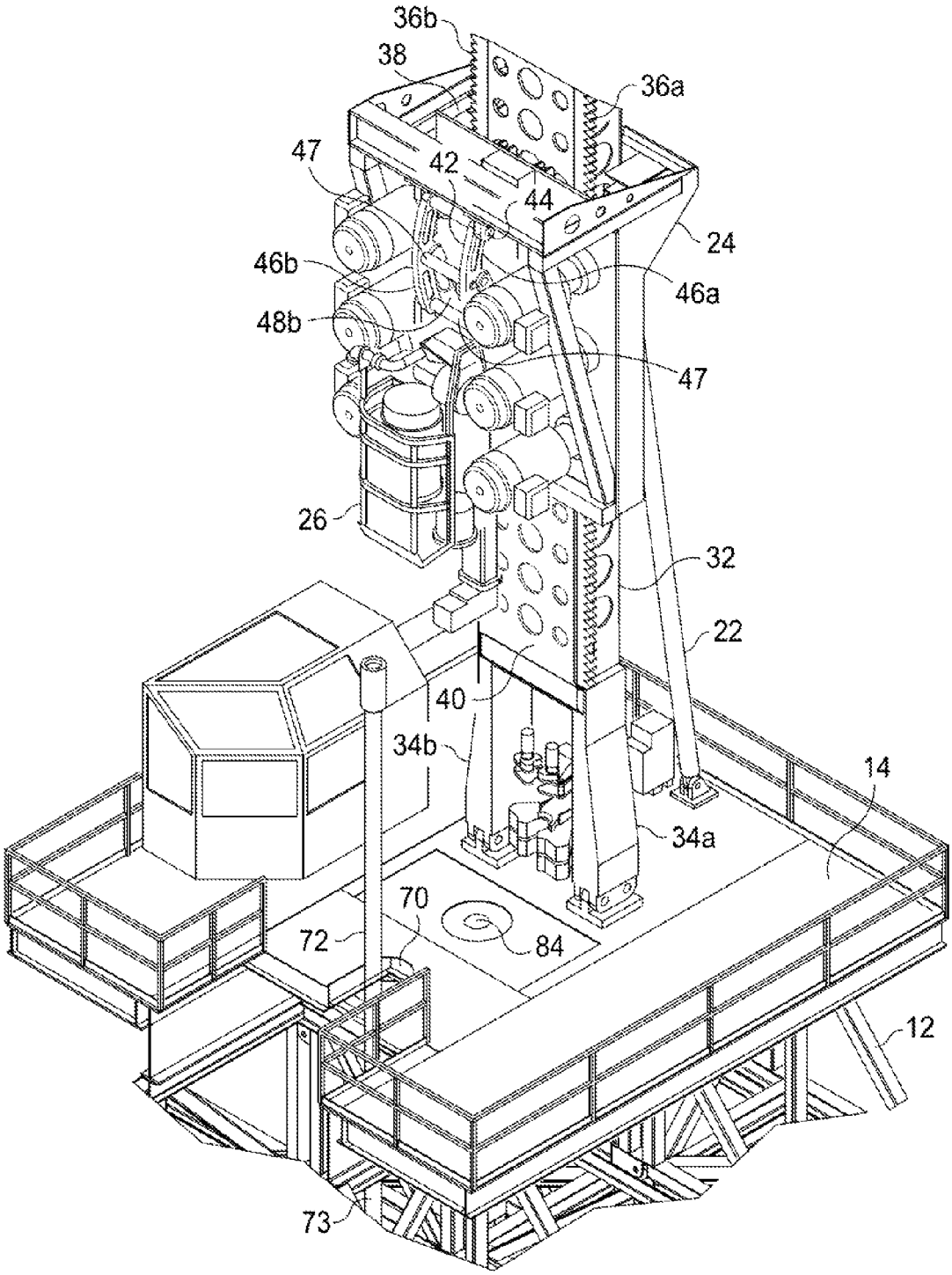
FIG. 2 is a perspective view of a portion of the apparatus shown in FIG. 1 according to one or more aspects of the present disclosure.
Figure 3:
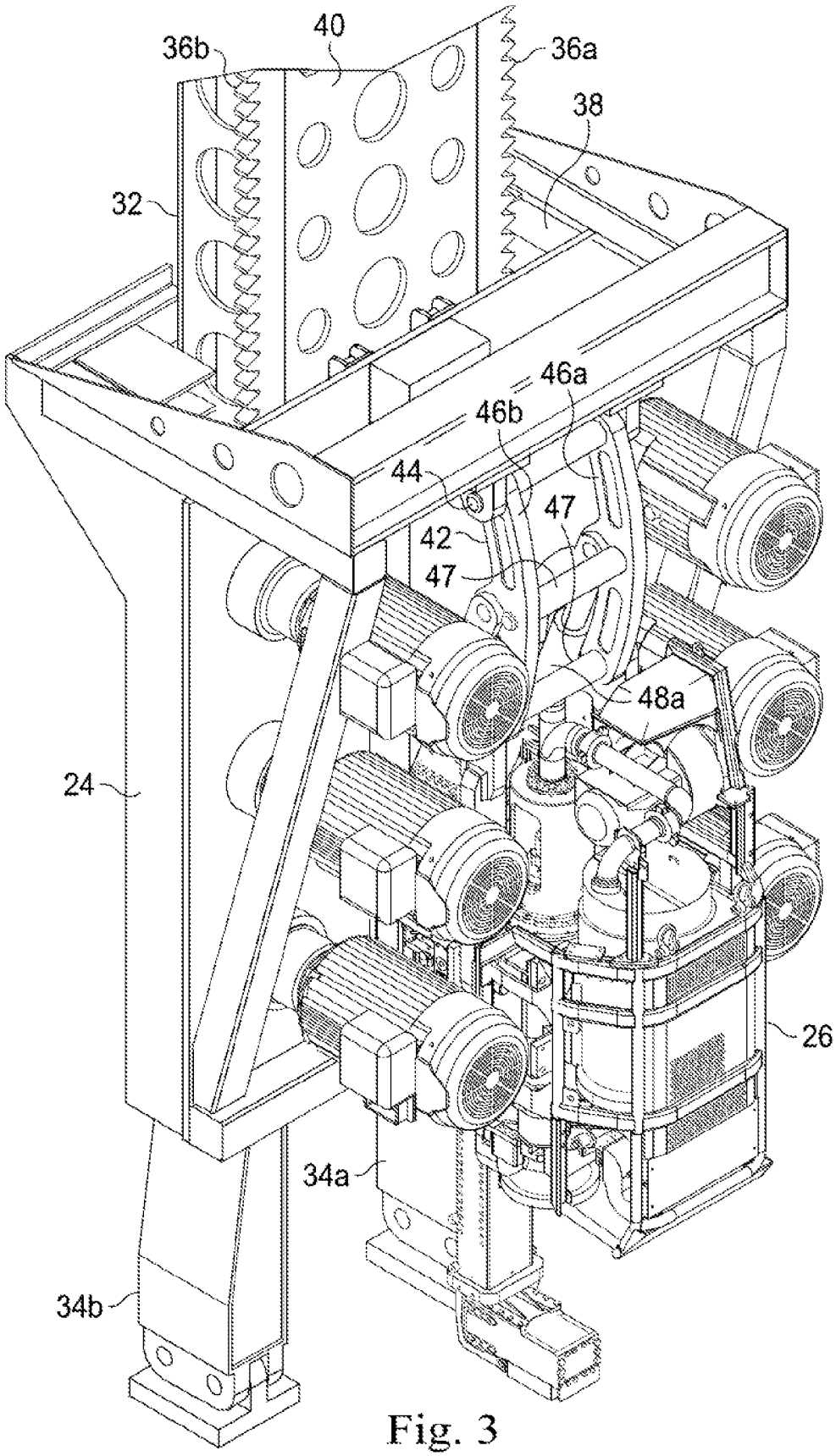
FIG. 3 is a perspective view of a portion of the apparatus shown in FIG. 1 according to one or more aspects of the present disclosure.

Referring to FIGS. 2 and 3, illustrated are perspective views of portions of the apparatus 10. The tower 18 includes a frame 32 and support legs 34*a* and 34*b*, which extend between the frame 32 and the rig floor 14. Racks 36*a* and 36*b* are coupled to opposing sides of the frame 32. In another embodiment (not shown), the racks 36*a* and 36*b* are integrally formed with the frame 32. The racks 36*a* and 36*b* extend through an opening 38 defined by the carriage 24. The frame 32 includes a front panel 40, which extends between the racks 36*a* and 36*b*. A linking member 42 is pivotally coupled to the carriage 24 at a pivot connection 44. The linking member 42 includes parallel-spaced arcuate members 46*a* and 46*b*, and a plurality of transversely-extending members 47 extending therebetween. Actuators 48*a* and 48*b* extend angularly between the carriage 24 and the arcuate members 46*a* and 46*b*, respectively. In an exemplary embodiment, the actuators 48*a* and 48*b* are hydraulic cylinders. In several exemplary embodiments, each of the actuators 48*a* and 48*b* is, includes, or is part of, a hydraulic actuator, an electromagnetic actuator, a pneumatic actuator, a linear actuator, and/or any combination thereof.

Figure 4:
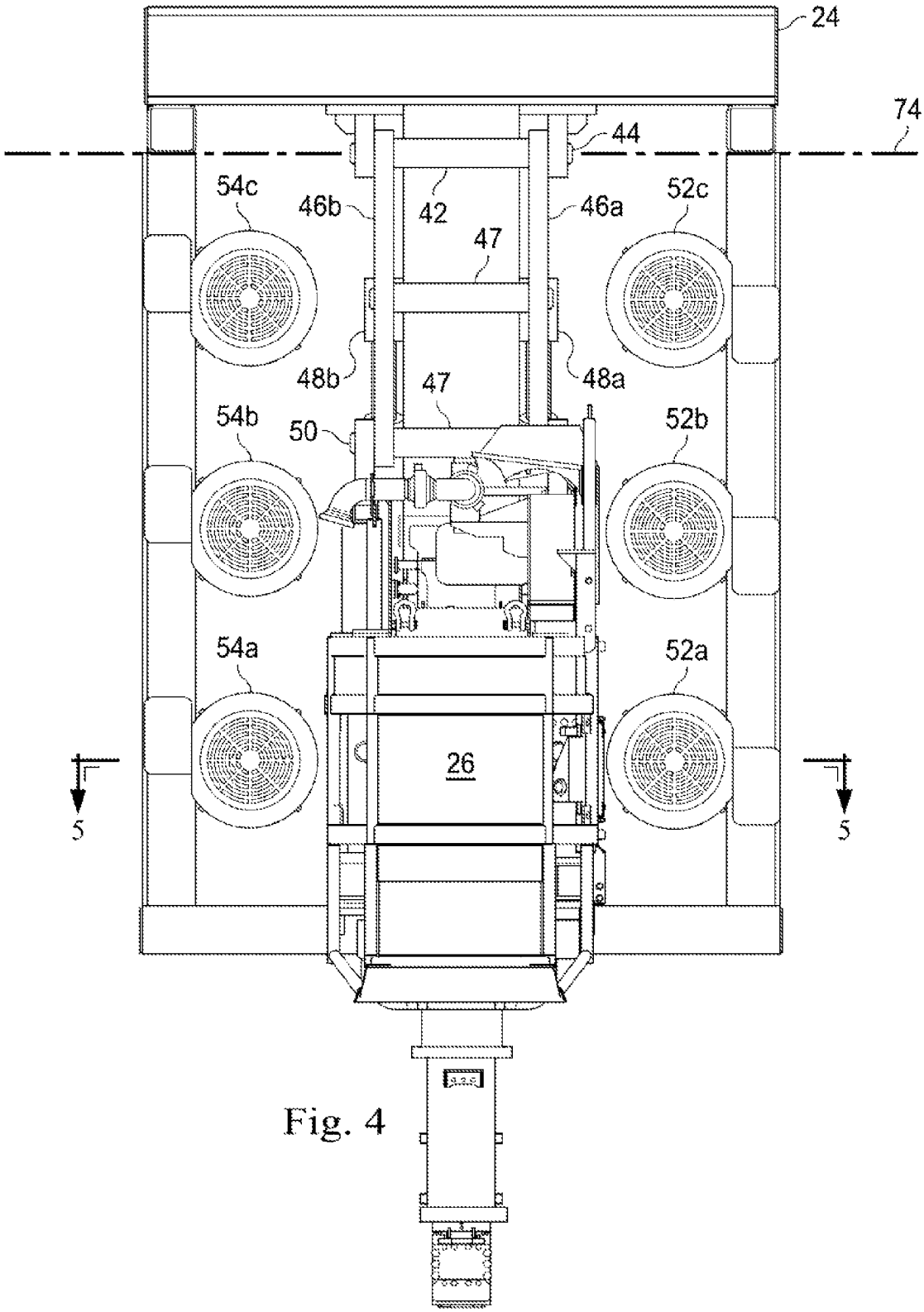
FIG. 4 is a front elevational view of a portion of the apparatus shown in FIG. 1 according to one or more aspects of the present disclosure.

Referring to FIG. 4, illustrated is an elevational view of a portion of the apparatus 10. As shown in FIG. 4, the top drive 26 is pivotally coupled to the linking member 42 at a pivot connection 50. Electric motors 52*a*, 52*b* and 52*c* are coupled to the carriage 24 and thus also to the top drive 26. Likewise, electric motors 54*a*, 54*b* and 54*c* are coupled to the carriage 24 and thus also to the top drive 26, and are spaced from the electric motors 52*a*, 52*b* and 52*c* in a direction that is perpendicular to the axis 20. In an exemplary embodiment, each of the electric motors 52*a*-52*c* and 54*a*-54*c* is an AC motor and is controlled by either a single variable-frequency drive (VFD) or multiple VFDs, which is/are synchronized and programmed to work simultaneously with the other motors to provide uniform motion and torque. In an exemplary embodiment, one or more of the electric motors 52*a*-52*c* and 54*a*-54*c* are controlled by a single VFD. In an exemplary embodiment, one or more the electric motors 52*a*-52*c* and 54*a*-54*c* are controlled by multiple VFDs. In an exemplary embodiment, each of the electric motors 52*a*-52*c* and 54*a*-54*c* is an AC motor and provides primary dynamic braking. In an exemplary embodiment, each of the electric motors 52*a*-52*c* and 54*a*-54*c* includes a gearbox and a brake therein or thereat. In an exemplary embodiment, each of the electric motors 52*a*-52*c* and 54*a*-54*c* includes an encoder incorporated on the motor shaft to provide more precise VFD control.

Figure 5:
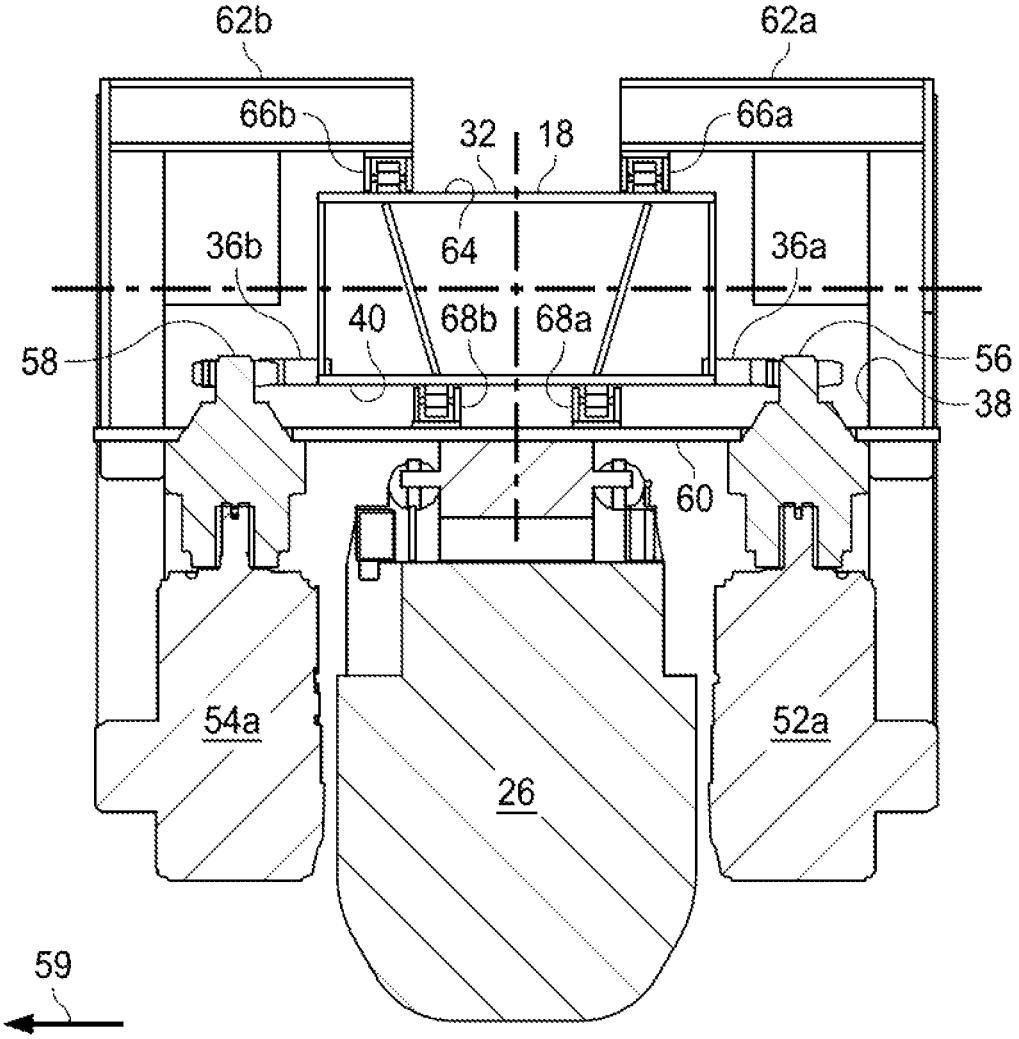
FIG. 5 is a section view taken along line 5-5 of FIG. 4 according to one or more aspects of the present disclosure.
Figure 6:
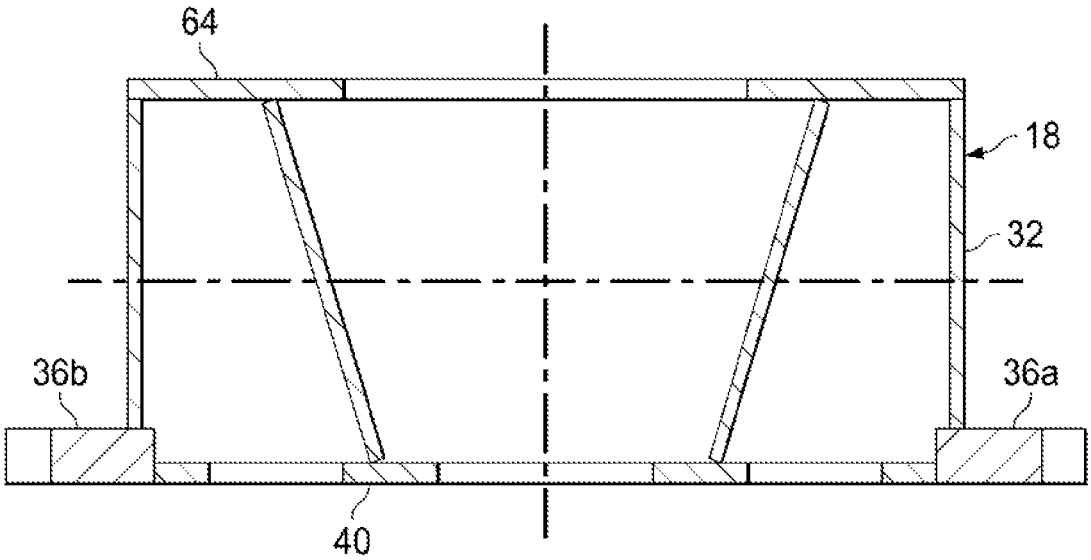
FIG. 6 is a section view of a component of the apparatus shown in FIG. 1 according to one or more aspects of the present disclosure.

Referring to FIGS. 5 and 6, illustrated are a section view taken along line 5-5 of FIG. 4, and a section view of the frame 32, respectively. A pinion 56 is operably coupled to the electric motor 52*a*. The pinion 56 is engaged with the rack 36*a*. Likewise, a pinion 58 is operably coupled to the electric motor 54*a*. The pinion 58 is engaged with the rack 36*b*, and is spaced from the pinion 56 in a direction 59 that is perpendicular to the axis 20. As shown in FIG. 5, the carriage 24 includes a center portion 60 and guide portions 62*a* and 62*b* extending therefrom. The guide portion 62*a* extends past the rack 36*a*, and wraps around the frame 32 to engage a panel 64 of the frame 32 via a guide element 66*a*. Similarly, the guide portion 62*b* extends past the rack 36*b* and wraps around the frame 32 to engage the panel 64 via a guide element 66*b*. The electric motors 52*a*-52*c* and 54*a*-54*c* are coupled to the center portion 60 of the carriage 24. The center portion 60 engages the panel 40 of the frame 32 via guide elements 68*a* and 68*b*.

Figure 7:
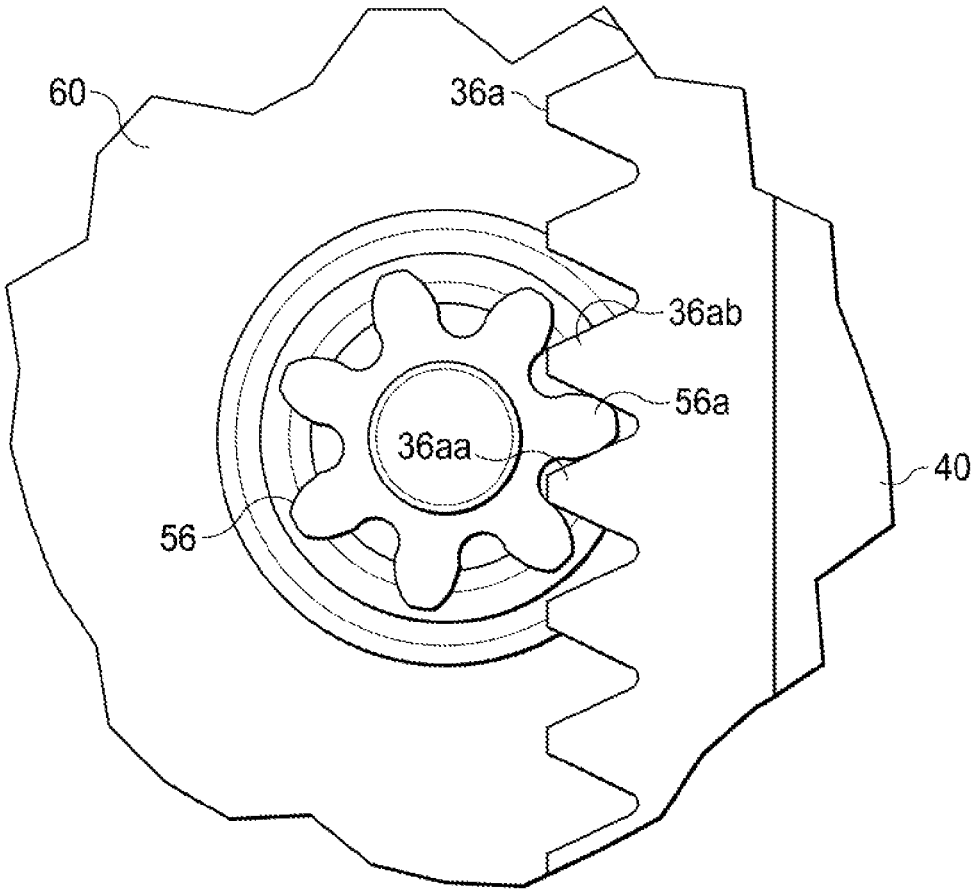
FIG. 7 is a rear elevational view of components of the apparatus shown in FIG. 1 according to one or more aspects of the present disclosure.

Referring to FIG. 7, illustrated is a rear elevational view of respective portions of the pinion 56, the rack 36*a*, the center portion 60 of the carriage 24, and the panel 40 of the frame 32 of the tower 18. As shown in FIG. 7, a tooth 56*a* of the pinion 56 extends between, and engages, adjacent teeth 36*aa* and 36*ab* of the rack 36*a*. Although not shown in the figures, pinions, each of which is substantially identical to the pinion 56, are operably coupled to the electric motors 52*b* and 52*c*, respectively, and engage the rack 36*a*. Similarly, pinions, each of which is substantially identical to the pinion 58, are operably coupled to the electric motors 54*b* and 54*c*, respectively, and engage the rack 36*b*.

In operation, in an exemplary embodiment with continuing reference to FIGS. 1-7, the apparatus 10 is employed to assemble a string of tubular members (or tubulars), such as drill pipe or casing as part of oil and gas exploration and production operations. More particularly, at least one tubular member is temporarily coupled to the top drive 26, which operates to couple (or separate) that tubular member to (or from) another tubular member which already extends within the wellbore 16 or is vertically positioned between the wellbore 16 and the tubular member coupled to the top drive 26. For all embodiments described herein, the operations disclosed herein may be conducted in reverse to trip pipe or casing out of a wellbore and disconnect tubular members or pairs of tubular members from the string of tubular members. For example, as shown in FIG. 2, an opening 70 is formed in the platform 12, and the opening 70 receives a tubular member 72 from a tubular handling device (not shown). As shown in FIGS. 1 and 2, a tubular member 73 may be coupled to the tubular member 72, and the top drive 26 may be employed to couple both the tubular members 72 and 73 to another tubular member which already extends within the wellbore 16 or is vertically positioned between the wellbore 16 and the tubular member 73; this other tubular member may be part of a string of drill pipe or casing.

The electric motors 52*a*-52*c* cause the respective pinions operably coupled thereto, including the pinion 56, to rotate and engage teeth of the rack 36*a*. Likewise, the electric motors 54*a*-54*c* cause the respective pinions operably coupled thereto, including the pinion 58, to rotate and engage teeth of the rack 36*b*. As a result, the carriage 24 and thus the top drive 26 move along the axis 20 and relative to the tower 18 as necessary so that the top drive 26 is at a position along the axis 20 at which the tubular member 72 can be coupled to the top drive 26. Before, during or after the top drive 26 is at that position along the axis 20, the actuators 48*a* and 48*b* actuate, extending their respective lengths. As a result, the linking member 42 pivots about an axis 74 (shown in FIG. 4), which extends through the pivot connection 44 and is perpendicular to the axis 20. As viewed in FIG. 1, the linking member 42 pivots in a counterclockwise direction about the axis 74. The linking member 42 pivots from a pivot position corresponding to respective retracted positions of the actuators 48*a* and 48*b*, to a pivot position corresponding to respective extended positions of the actuators 48*a* and 48*b*. During this pivoting, the pivot connection 50 pivots about the pivot connection 44 in a counterclockwise direction, as viewed in FIG. 1. Since the top drive 26 is pivotally coupled to the linking member 42 at the pivot connection 50, the top drive 26 continues to extend longitudinally in a parallel relation to the tower 18 when the linking member 42 pivots.

As a result of the extension of the actuators 48*a* and 48*b* and thus the pivoting of each of the linking member 42 and the top drive 26, the top drive 26 moves between the position 28 and the position 30, which positions are shown in FIG. 1. Thus, the top drive 26 is spaced from the tower 18 by a spacing 76, the spacing 76 extending in a direction 78 that is perpendicular to the axis 20. An axis 80 is defined by the opening 70, and is spaced in a parallel relation from the axis 20 by the spacing 76. After the top drive 26 is at the position 30, the top drive 26 moves downward along the axis 80 and couples to the tubular member 72. The electric motors 52*a*-52*c* and 54*a*-54*c* move the top drive 26 upward along the axis 80 and relative to the tower 18, lifting the tubular member 72 and the tubular member 73 coupled thereto.

After the tubular member 73 has vertically cleared the rig floor 14, the actuators 48*a* and 48*b* are actuated to their respective retracted positions. To be clear, the vertical clearance should be sufficient to provide clearance of the tubular member 73 even if it is lowered slightly as the top drive 26 returns to the position 28; alternatively, it is desired to have a corresponding upward movement of the top drive 26 along the axis 80 as the top drive 26 returns to the position 28 as further discussed below. As a result, the linking member 42 pivots about the axis 74. As viewed in FIG. 1, the linking member 42 pivots in a clockwise direction about the axis 74. Since the top drive 26 is pivotally coupled to the linking member 42 at the pivot connection 50, the top drive 26 continues to extend longitudinally in a parallel relation to the tower 18 when the linking member 42 pivots. As a result of the retraction of the actuators 48*a* and 48*b* and thus the pivoting of each of the linking member 42 and the top drive 26, the top drive 26 is spaced from the tower 18 by a spacing 82, the spacing 82 extending in the direction 78. The spacing 82 is less than the spacing 76. In an exemplary embodiment, as a result of the retraction of the actuators 48*a* and 48*b* and thus the pivoting of the linking member 42 and the top drive 26, the top drive 26 moves from the position 30 and back to the position 28. In several exemplary embodiments, as a result of the retraction of the actuators 48*a* and 48*b* and thus the pivoting of the linking member 42 and the top drive 26, the top drive 26 moves from the position 30 and back to a position located between the positions 28 and 30 in the direction 78.

The electric motors 52*a*-52*c* and 54*a*-54*c* move the top drive 26 downward along the axis 20 and relative to the tower 80, lowering the tubular members 72 and 73 through an opening 84 formed in the platform 12. The opening 84 defines an axis 86, which is spaced in a parallel relation from the axis 20 by the spacing 82. The axis 86 is generally coaxial with the wellbore 16. Before, during or after the lowering of the tubular members 72 and 73, the top drive 26 operates to couple the tubular member 73 to another tubular member either extending in the wellbore 16 or being vertically positioned between the wellbore 16 and the tubular member 73; this other tubular member may be part of a string of drill pipe or casing. In several exemplary embodiments, during or after the lowering of the tubular members 72 and 73, the top drive 26 is positioned at the position 28 shown in FIG. 1, or at a position located between the positions 28 and 30 in the direction 78.

In an exemplary embodiment, the motors 52*c* and 54*c* may be omitted from the apparatus 10. In an exemplary embodiment, the motors 52*b*, 52*c*, 54*b* and 54*c* may be omitted from the apparatus 10. In an exemplary embodiment, in addition to the motors 52*a*-52*c* and 54*a*-54*c*, one or more additional electric motors may be coupled to the carriage 24 and employed to move the top drive 26.

Figure 8:
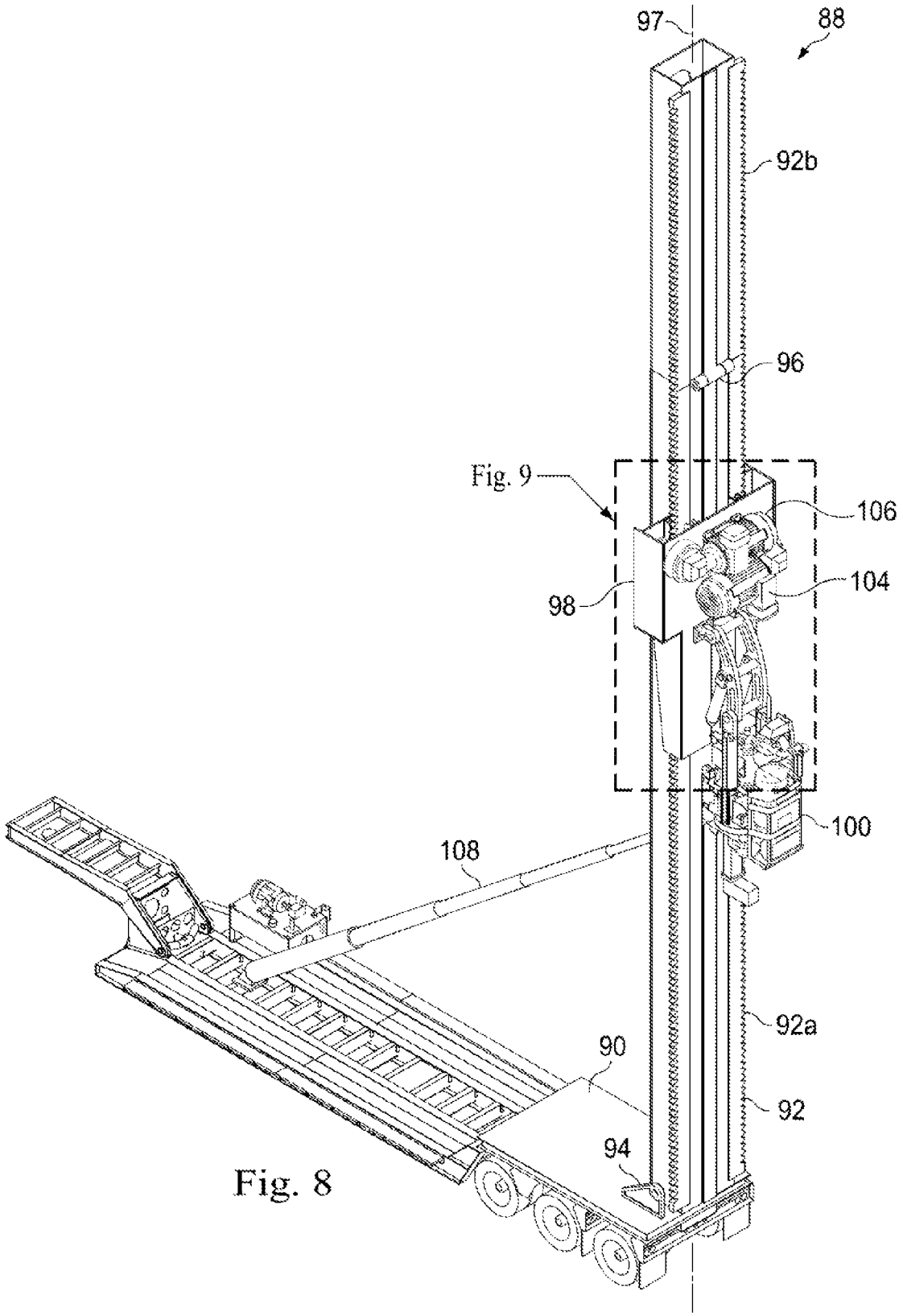
FIG. 8 is a perspective view of an apparatus according to one or more aspects of the present disclosure.

Referring to FIG. 8, illustrated is a perspective view of an apparatus 88, which includes a base 90 and a drilling mast or tower 92 pivotally coupled thereto at a pivot connection 94. In an exemplary embodiment, the base 90 is part of, or is mounted on, a mobile trailer. The tower 92 includes a portion 92*a* and a portion 92*b* pivotally coupled thereto at a pivot connection 96. The portion 92*a* extends longitudinally along an axis 97. When the portion 92*b* is in the pivot position shown in FIG. 8, the portion 92*b* also extends longitudinally along the axis 97. A carriage 98 is movably coupled to the tower 92. A top drive 100 is coupled to the carriage 98. The top drive 100 extends longitudinally in a parallel relation to the tower 92. In several exemplary embodiments, the apparatus 88 does not include the top drive 100; instead, the apparatus 88 may be, include, or be a part of, another type of drilling rig such as, for example, a rotary-swivel rig or a power-swivel rig.

Electric motors 104 and 106 are coupled to the carriage 98 and thus to the top drive 100. The electric motors 104 and 106 are spaced from each other in a direction that is parallel to the axis 97. In an exemplary embodiment, each of the electric motors 104 and 106 is an AC motor and is controlled by either a single variable-frequency drive (VFD) or multiple VFDs, which is/are synchronized and programmed to work simultaneously with the other motors to provide uniform motion and torque. In an exemplary embodiment, one or more of the electric motors 104 and 106 are controlled by a single VFD. In an exemplary embodiment, one or more the electric motors 104 and 106 are controlled by multiple VFDs. In an exemplary embodiment, each of the electric motors 104 and 106 is an AC motor and provides primary dynamic braking. In an exemplary embodiment, each of the electric motors 104 and 106 includes a gearbox and a brake therein or thereat. In an exemplary embodiment, each of the electric motors 104 and 106 includes an encoder incorporated on the motor shaft to provide more precise VFD control. A telescoping support member 108 extends between the base 90 and the portion 92*a* of the tower 92.

Figure 9:
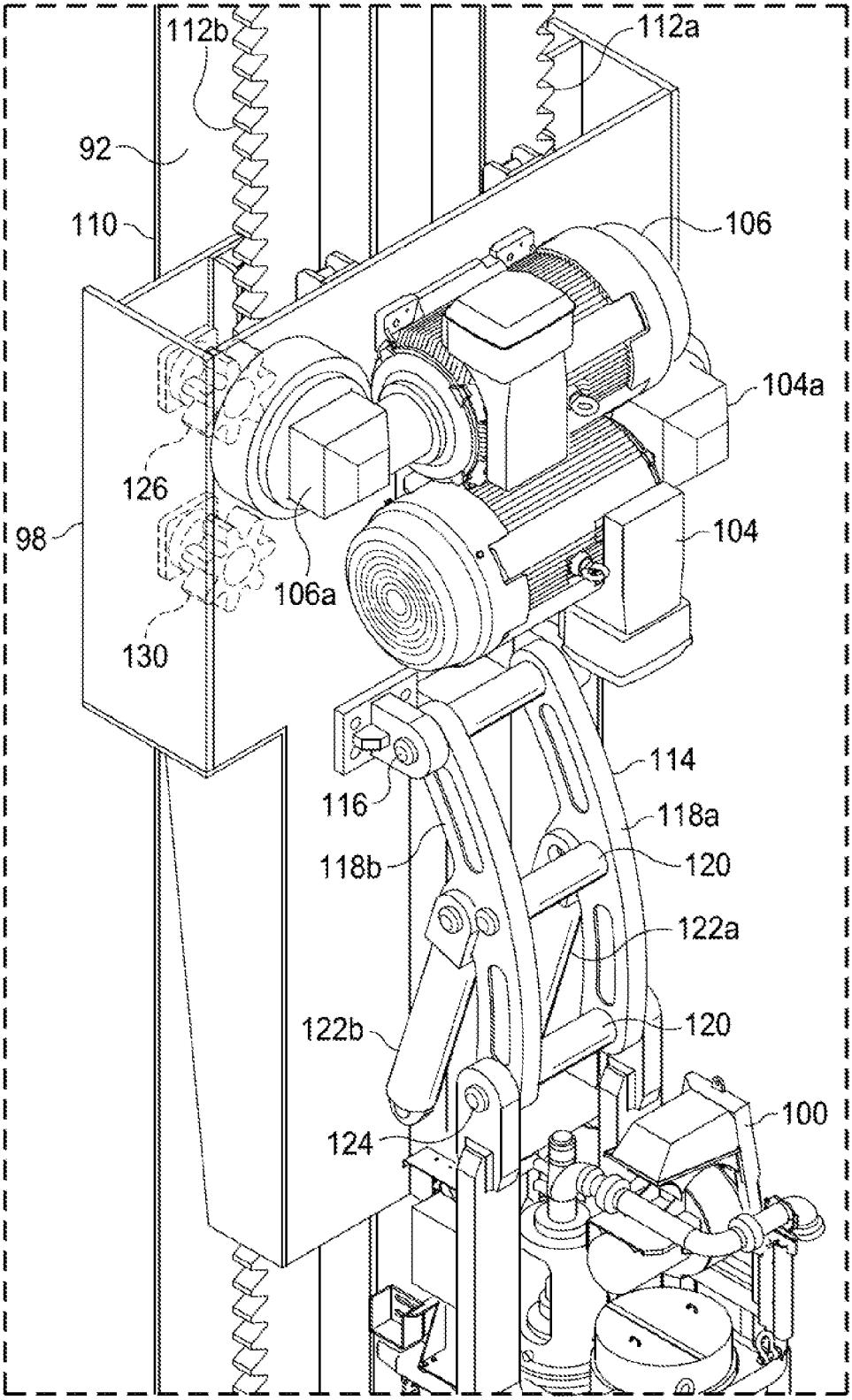
FIG. 9 is an enlarged view of a portion of the apparatus shown in FIG. 8 according to one or more aspects of the present disclosure.
Figure 10:
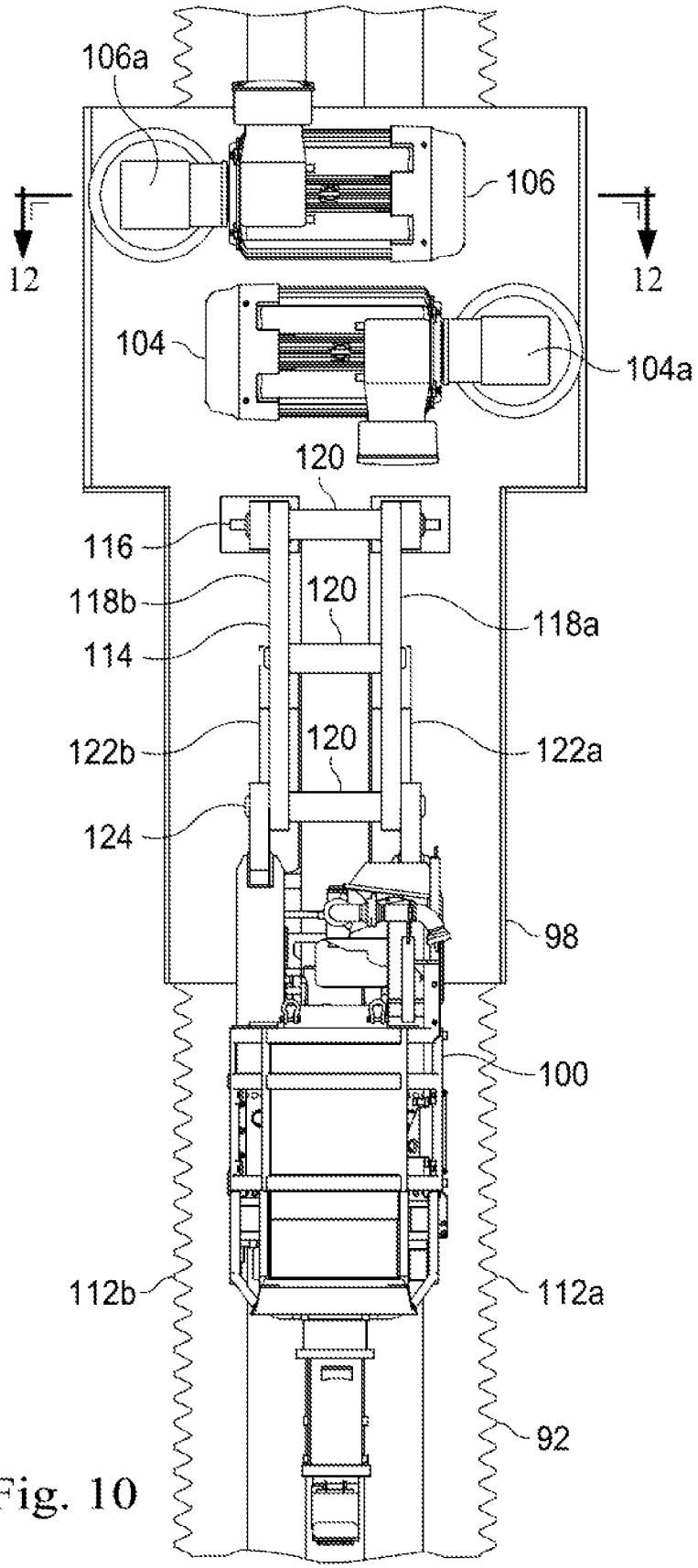
FIG. 10 is a front elevational view of a portion of the apparatus shown in FIG. 8 according to one or more aspects of the present disclosure.
Figure 11:
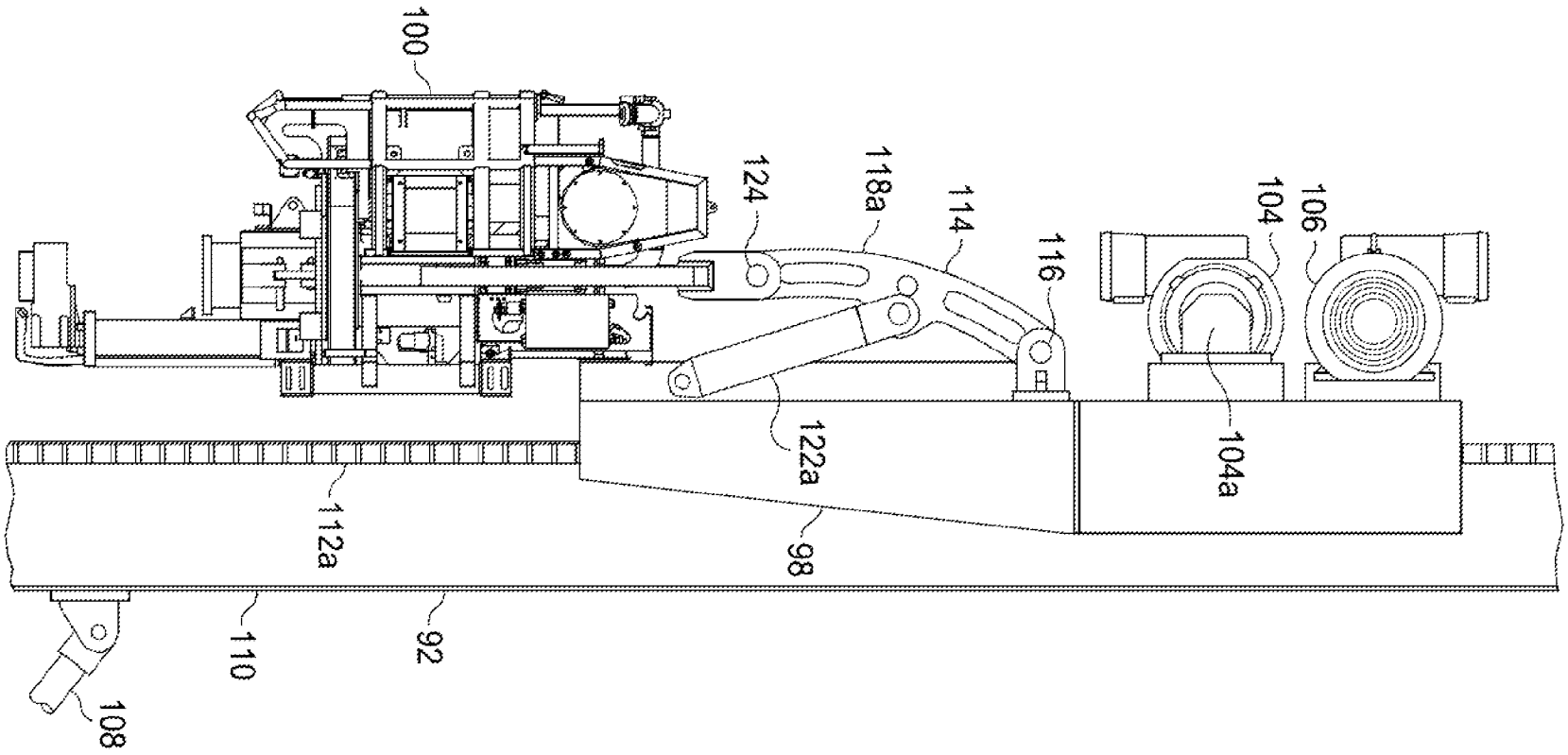
FIG. 11 is a side elevational view of the portion shown in FIG. 10 according to one or more aspects of the present disclosure.

Referring to FIGS. 9, 10 and 11, illustrated are perspective and elevational views of a portion of the apparatus 88. The tower 92 includes a frame 110, and racks 112*a* and 112*b* coupled to opposing sides of the frame 110. In another embodiment, the frame 110 and the racks 112*a* and 112*b* are integrally formed. A linking member 114 is pivotally coupled to the carriage 98 at a pivot connection 116. The linking member 114 includes parallel-spaced arcuate members 118*a* and 118*b*, and a plurality of transversely-extending members 120 extending therebetween. Actuators 122*a* and 122*b* extend angularly between the carriage 98 and the arcuate members 118*a* and 118*b*, respectively. In an exemplary embodiment, the actuators 122*a* and 122*b* are hydraulic cylinders. In several exemplary embodiments, each of the actuators 122*a* and 122*b* is, includes, or is part of, a hydraulic actuator, an electromagnetic actuator, a pneumatic actuator, a linear actuator, and/or any combination thereof. The top drive 100 is pivotally coupled to the linking member 114 at a pivot connection 124. The electric motors 104 and 106 include right-angle drives 104*a* and 106*a*, respectively.

Figure 12:
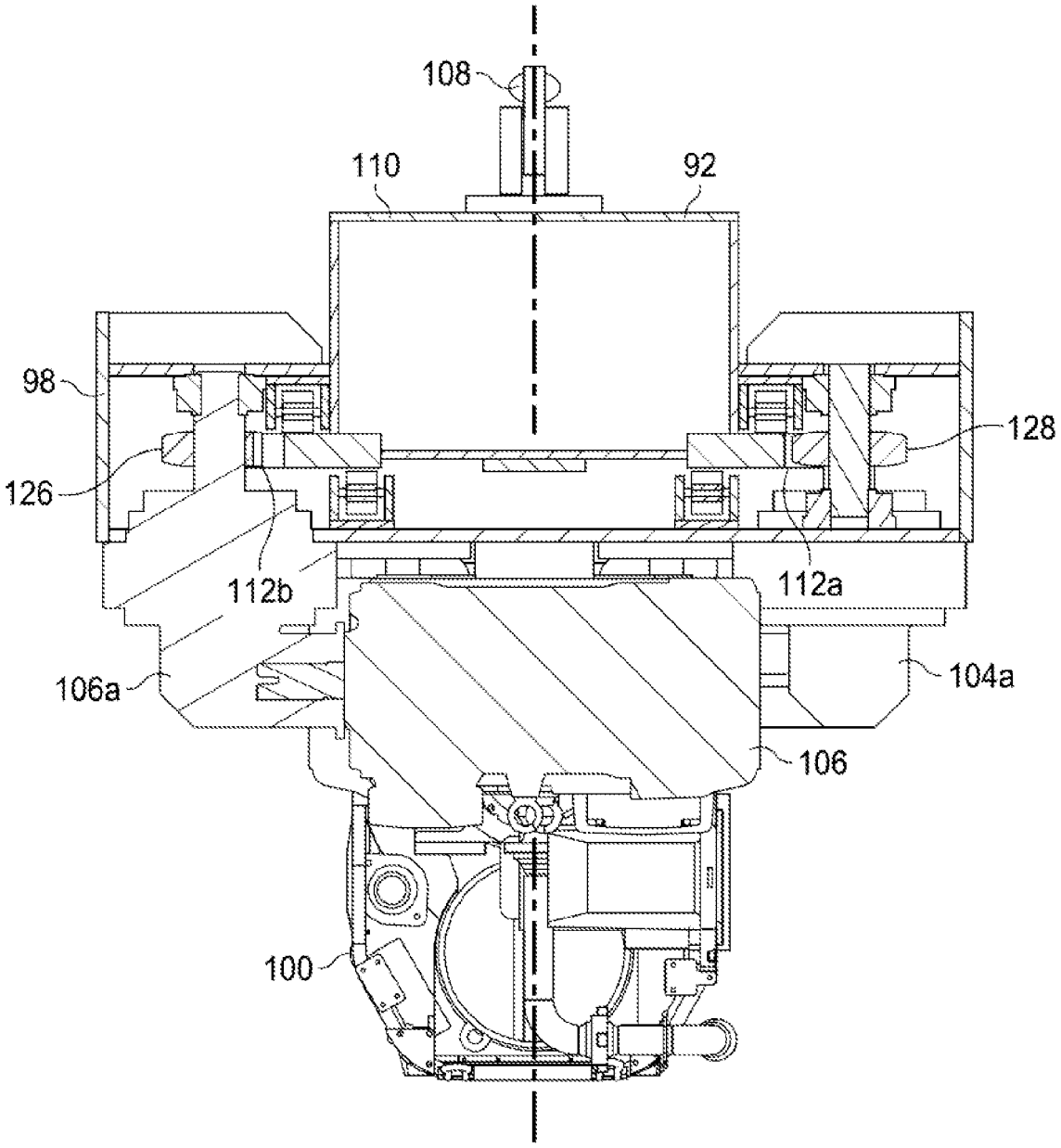
FIG. 12 is a section view taken along line 12-12 of FIG. 10 according to one or more aspects of the present disclosure.

Referring to FIG. 12, illustrated is a section view taken along line 12-12 of FIG. 10. A pinion 126 is operably coupled to the electric motor 106. Although not shown, a pinion that is identical to the pinion 126 is operably coupled to the electric motor 104 in a manner identical to the manner by which the pinion 126 is operably coupled to the electric motor 106. A pinion 128 is coupled to the carriage 98 and engages the rack 112*a*. Unlike the pinion 126, the pinion 128 is not operably coupled to an electric motor and thus does not rotate to cause the carriage 98 to move relative to the tower 92; instead, the pinion 128 rotates in response to movement of the carriage 98 relative to the tower 92. A pinion 130 (shown in hidden lines in FIG. 9) is coupled to the carriage 98 and engages the rack 112*b*. Unlike the pinion 126, the pinion 130 is not operably coupled to an electric motor and thus does not rotate to cause the carriage 98 to move relative to the tower 92; instead, the pinion 130 rotates in response to movement of the carriage 98 relative to the tower 92.

In operation, with continuing reference to FIGS. 8-12, in an exemplary embodiment, the base 90 is positioned adjacent a rig substructure (not shown). The portion 92*a* initially extends parallel to the base 90 in, for example, a horizontal arrangement. The portion 92*b* of the tower 92 initially is in a pivot position at which the portion 92*b* is folded back over onto the portion 92*a* of the tower 92. The portion 92*b* is pivoted at the pivot connection 96 in a clockwise direction as viewed in FIG. 11, and a counterclockwise direction as viewed in FIG. 8 to extend, such as to its full length. The portion 92*b* continues to so pivot until the portion 92*b* is at the pivot position shown in FIGS. 8-12, at which position the portions 92*a* and 92*b* are flush and extend longitudinally along the axis 97, and the carriage 98 and thus the top drive 100 are movable along each of the portions 92*a* and 92*b*. The telescoping support member 108 is actuated, causing the tower 92, and thus the carriage 98 and the top drive 100, to pivot at the pivot connection 94, in a clockwise direction as viewed in FIG. 8.

In an exemplary embodiment, during operation, the electric motor 106 causes the pinion 126 to rotate and engage the teeth of the rack 112*b*. Likewise, the electric motor 104 causes the pinion operably coupled thereto (which is identical to the pinion 126) to rotate and engage the teeth of the rack 112*a*. As a result, the carriage 98 and thus the top drive 100 move up or down, along the axis 97 and relative to the tower 92 as necessary or desired.

In several exemplary embodiments, during operation, before, during or after the top drive 100 is at a necessary or desired position along the axis 97, the actuators 122*a* and 122*b* may actuate, extending their respective lengths. As a result, the linking member 114 pivots at the pivot connection 116. As viewed in FIG. 11, the linking member 114 pivots in a clockwise direction at the pivot connection 116. The linking member 114 pivots from a pivot position corresponding to respective retracted positions of the actuators 122*a* and 122*b*, to a pivot position corresponding to respective extended positions of the actuators 122*a* and 112*b*. Since the top drive 100 is pivotally coupled to the linking member 114 at the pivot connection 124, the top drive 100 continues to extend longitudinally in a parallel relation to the tower 92 when the linking member 114 pivots. The horizontal spacing between the tower 92 and the top drive 100 increases as a result of the linking member 114 pivoting from a pivot position corresponding to respective retracted positions of the actuators 122*a* and 122*b*, to a pivot position corresponding to respective extended positions of the actuators 122*a* and 112*b*.

In several exemplary embodiments, during operation, after the linking member 114 has pivoted to a pivot position corresponding to the respective extended positions of the actuators 112*a* and 112*b*, the actuators 112*a* and 112*b* may be actuated to their respective retracted positions. As a result, the linking member 114 pivots in a counterclockwise direction, as viewed in FIG. 11. Since the top drive 100 is pivotally coupled to the linking member 114 at the pivot connection 124, the top drive 100 continues to extend longitudinally in a parallel relation to the tower 92 when the linking member 114 pivots. The horizontal spacing between the tower 92 and the top drive 100 decreases as a result of the retraction of the actuators 112*a* and 112*b* and thus the pivoting of each of the linking member 114 and the top drive 100.

In operation, in an exemplary embodiment, the apparatus 88 is employed to assemble a string of tubular members, such as drill pipe or casing as part of oil and gas exploration and production operations, in a manner similar to the above-described manner in which the apparatus 10 is employed to assemble a string of tubular members. In several exemplary embodiments, during operation, after the apparatus 88 has been placed in the configuration shown in FIGS. 8-12 by pivoting the portion 92*b*, and pivoting the tower 92, aspects of the operation of the apparatus 88 are substantially similar to corresponding aspects of the above-described operation of the apparatus 10. Therefore, the operation of the embodiment of the apparatus 88 illustrated in FIGS. 8-12 will not be described in further detail.

Figure 13:
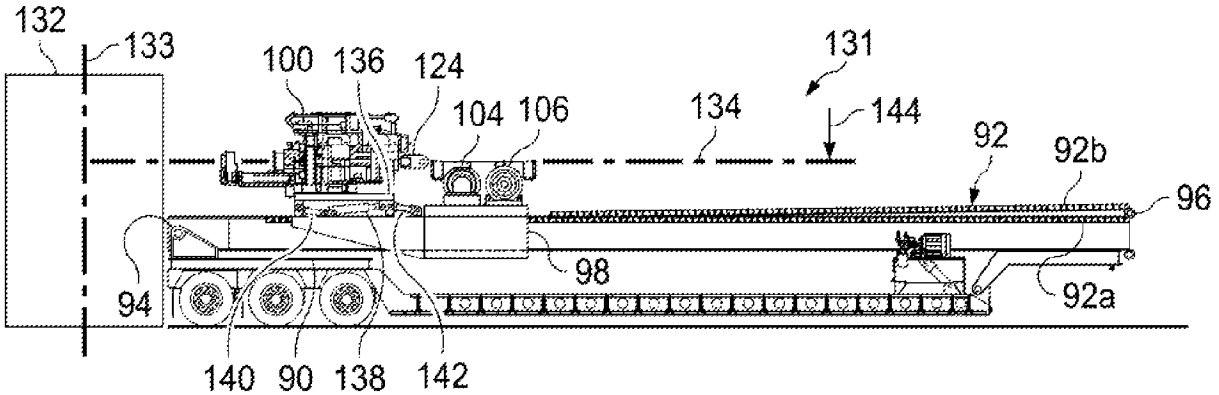
FIG. 13 is an elevational view of an apparatus according to one or more aspects of the present disclosure.
Figure 14:
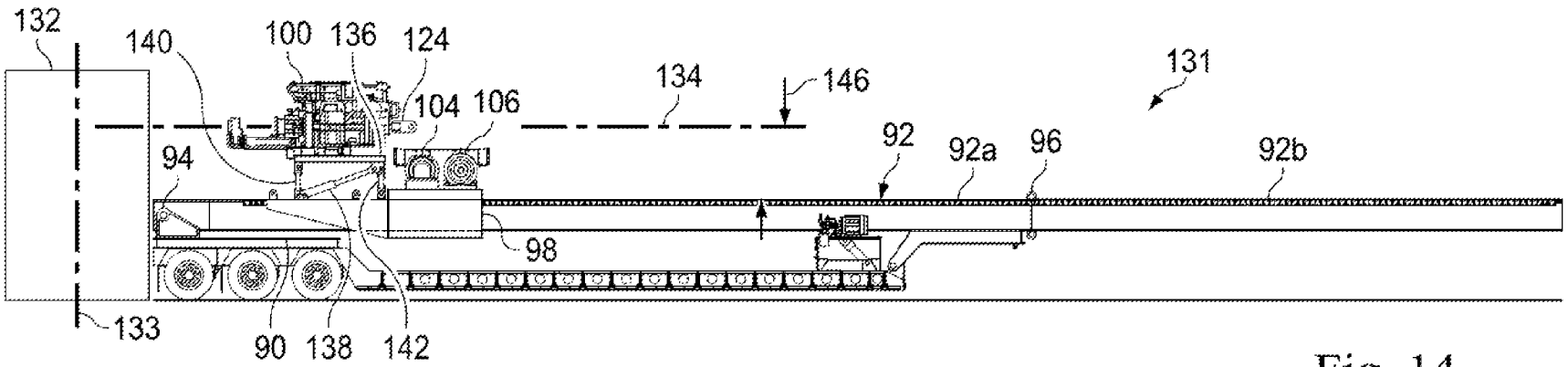
FIG. 14 is a view similar to that of FIG. 13, but depicts a different operational mode of the apparatus according to one or more aspects of the present disclosure.
Figure 15:
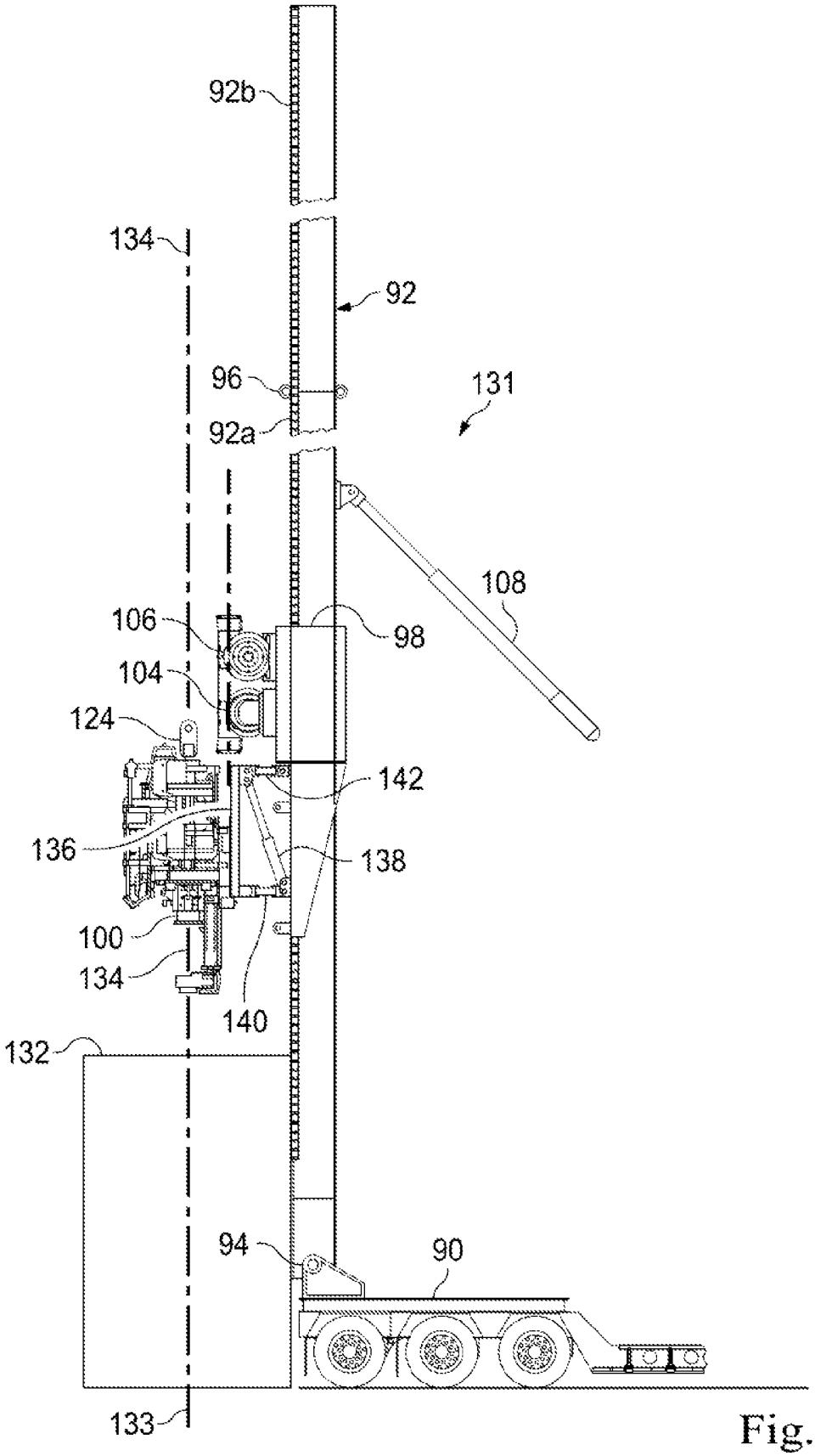
FIG. 15 is an elevational view of a portion of the apparatus shown in FIGS. 13 and 14, but depicts a different operational mode of the apparatus according to one or more aspects of the present disclosure.

Referring to FIGS. 13, 14 and 15, illustrated are elevational views of an apparatus 131, which, unless otherwise noted below, contains the parts of the apparatus 88, which parts are given the same reference numerals. As shown in FIGS. 13-15, the top drive 100 defines an axis 134. In contrast to the apparatus 88 illustrated in FIGS. 8-12, the linking member 114, the pivot connection 116, the arcuate members 118*a* and 118*b*, the plurality of transversely-extending members 120, the actuators 122*a* and 122*b*, and the pivot connection 124 are omitted from the apparatus 131 illustrated in FIGS. 13-15. Instead, in the apparatus 131 illustrated in FIGS. 13-15, the top drive 100 includes a support member 136, which extends in a parallel relation to the portion 92*a*. An actuator 138 extends between the carriage 98 and the support member 136. In an exemplary embodiment, the actuator 138 includes a plurality of parallel-spaced actuators, each of which is identical to the actuator 138. A linking member 140 is pivotally coupled to each of the carriage 98 and the support member 136. The linking member 140 is pivotally coupled to the support member 136 at one end portion thereof. In an exemplary embodiment, the linking member 140 includes a plurality of parallel-spaced linking members, each of which is identical to the linking member 140. A linking member 142 is pivotally coupled to each of the carriage 98 and the support member 136. The linking member 142 is pivotally coupled to the support member 136 at the end portion thereof opposite the end portion at which the linking member 140 is pivotally coupled. In an exemplary embodiment, the linking member 142 includes a plurality of parallel-spaced linking members, each of which is identical to the linking member 142.

In operation, in an exemplary embodiment, the base 90 is positioned adjacent a rig substructure 132, which defines an axis 133. As shown in FIG. 13, the portion 92*a* initially extends horizontally along the base 90. The portion 92*b* of the tower 92 initially is in a pivot position at which the portion 92*b* is folded back over onto the portion 92*a* of the tower 92. The portion 92*b* is pivoted at the pivot connection 96 in a clockwise direction, as viewed in FIGS. 13 and 14. The portion 92*b* continues to so pivot until the portion 92*b* is at the pivot position shown in FIG. 14, at which position the portions 92*a* and 92*b* are flush at an adjacent end of each, and the carriage 98 and thus the top drive 100 are movable along each of the portions 92*a* and 92*b*.

Before the portion 92*b* is pivoted from the pivot position shown in FIG. 13 to the pivot position shown in FIG. 14, the actuator 138 is in its retracted position, as shown in FIG. 13. As a result, a spacing 144 is defined between the axis 134 and the portion 92*a* of the tower 92.

Before, during or after the portion 92*b* is pivoted from the pivot position shown in FIG. 13 to the pivot position shown in FIG. 14, the actuator 138 is actuated to place the actuator 138 in its extended position. As a result of the extension of the actuator 138, the linking members 140 and 142 pivot about their respective pivot connections at the carriage 98, pivoting in a clockwise direction as viewed in FIG. 14. As a result, a spacing 146 is defined between the axis 134 and the portion 92*a* of the tower 92. The spacing 146 is greater than the spacing 144. Since the top drive 100 is coupled to the support member 136, the top drive 100 continues to extend longitudinally in a parallel relation to the tower 92 when the linking members 140 and 142 pivot.

As shown in FIG. 15, the telescoping support member 108 is actuated, causing the tower 92, and thus the carriage 98 and the top drive 100, to pivot at the pivot connection 94, in a counterclockwise direction as viewed in FIG. 15. As a result, the axis 134 is aligned with the axis 133 of the rig substructure.

In an exemplary embodiment, during operation, the electric motor 106 causes the pinion 126 to rotate and engage the teeth of the rack 112*b*. Likewise, the electric motor 104 causes the pinion operably coupled thereto (which is identical to the pinion 126) to rotate and engage the teeth of the rack 112*a*. As a result, the carriage 98 and thus the top drive 100 move up or down, relative to the tower 92, as necessary or desired.

In several exemplary embodiments, during operation, before, during or after the top drive 100 is at a necessary or desired position relative to the tower 92, the actuator 138 may be actuated to its retracted position. As a result, the linking members 140 and 142 pivot about their respective pivot connections at the carriage 98, pivoting in a counterclockwise direction as viewed in FIG. 15. Since the top drive 100 is coupled to the support member 136, the top drive 100 continues to extend longitudinally in a parallel relation to the tower 92 when the linking members 140 and 142 pivot.

In operation, in an exemplary embodiment, the apparatus 131 is employed to assemble a string of tubular members, such as drill pipe or casing as part of oil and gas exploration and production operations, in a manner similar to the above-described manner in which the apparatus 10 is employed to assemble a string of tubular members. In several exemplary embodiments, during operation, after the apparatus 131 has been placed in the configuration shown in FIG. 15 by pivoting the portion 92*b*, and pivoting the tower 92, aspects of the operation of the apparatus 131 are substantially similar to corresponding aspects of the above-described operation of the apparatus 10. Therefore, the operation of the apparatus 131 illustrated in FIGS. 13-15 will not be described in further detail.

Figure 16:
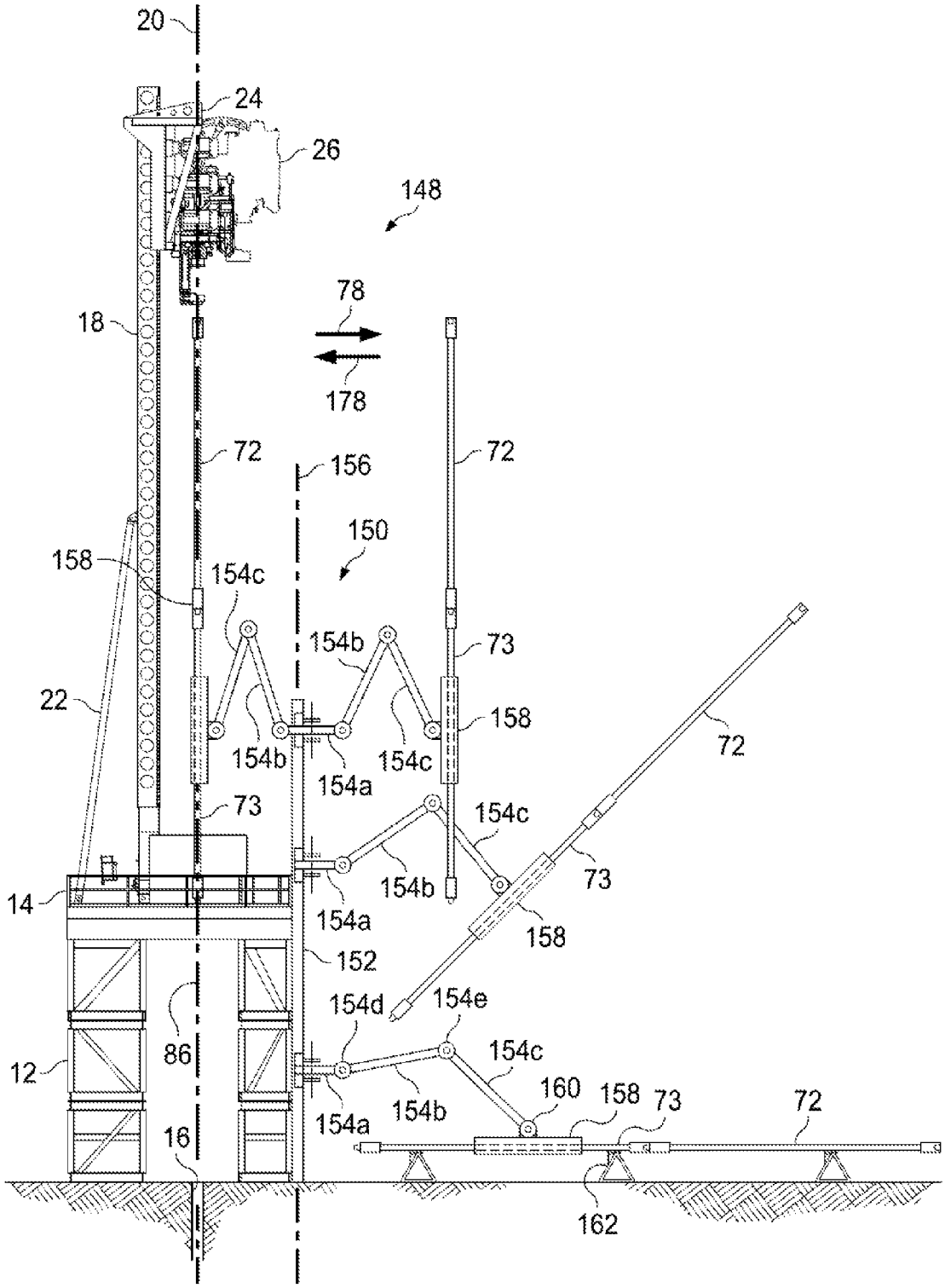
FIG. 16 is a schematic elevational view of an apparatus according to one or more aspects of the present disclosure.
Figure 17:
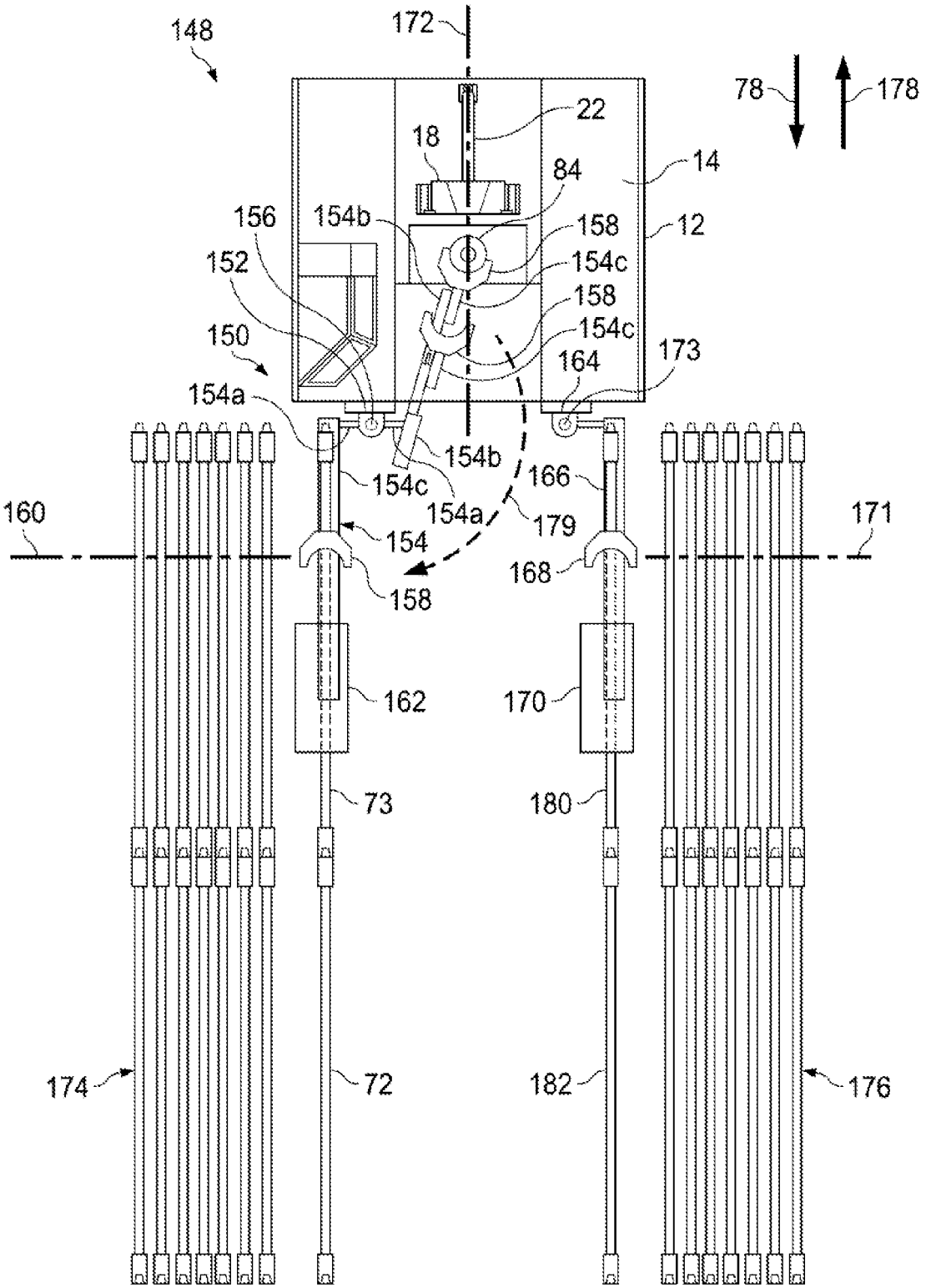
FIG. 17 is a schematic top plan view of the apparatus shown in FIG. 16 according to one or more aspects of the present disclosure.

Referring to FIGS. 16 and 17, illustrated are elevational and top plan views of an apparatus 148. In an exemplary embodiment, the apparatus 148 includes all of the above-described components of the apparatus 10, and these components are given the same reference numerals. In an exemplary embodiment, the apparatus 148 includes all of the above-described components of the apparatus 10, except that the apparatus 148 does not include the opening 70, the linking member 44, and the actuators 46*a* and 46*b*.

The apparatus 148 further includes a tubular handling device 150. The tubular handling device 150 includes a vertically-extending support member 152. An arm 154 is pivotally coupled to the vertically-extending support member 152. At its pivot coupling to the vertically-extending support member 152, the arm 154 defines an axis 156, which is parallel to the axis 20 and spaced therefrom in the direction 78. A gripper 158 is coupled to the distal end portion of the arm 154. An axis 160 is defined by the arm 154 at its coupling to the gripper 158. The axis 160 is perpendicular to the axis 156, regardless of the pivot position of the arm 154 with respect to the axis 156.

The arm 154 includes segments 154*a*, 154*b* and 154*c*. The segment 154*a* is pivotally coupled to the vertically-extending support member 152. The segment 154*b* is pivotally coupled to the segment 154*a* at a pivot connection 154*d*. The segment 154*c* is pivotally coupled to the segment 154*b* at a pivot connection 154*e*. The gripper 158 is coupled to the segment 154*c* at the axis 160. A support pedestal 162 of one or more supports is positioned proximate the platform 12.

The tubular handling device 150 further includes a vertically-extending support member 164, an arm 166, a gripper 168 and a support pedestal 170, which are identical to the vertically-extending member 152, the arm 154, the gripper 158 and the support pedestal 162, respectively. An axis 171 is defined by the arm 166 at its coupling to the gripper 168. The vertically-extending support member 164, the arm 166, the gripper 168 and the support pedestal 170 are arranged to be symmetric, about an axis 172, to the vertically-extending member 152, the arm 154, the gripper 158 and the support pedestal 162, respectively. The axis 172 is perpendicular to each of the axes 20 and 74, extends midway between the racks 36*a* and 36*b*, and intersects the axis 86. At its pivot coupling to the vertically-extending support member 164, the arm 166 defines an axis 173, which is parallel to the axis 20 and spaced therefrom in the direction 78. The axis 173 is parallel to the axis 156 and symmetric thereto about the axis 172. The axis 171 is perpendicular to the axis 173, regardless of the pivot position of the arm 166 with respect to the axis 173. The vertically-extending member 152, the arm 154, the gripper 158 and the support pedestal 162 will not be described in further detail.

The apparatus 148 further includes a plurality of tubular members 174 positioned proximate the support pedestal 162, and a plurality of tubular members 176 positioned proximate the support pedestal 170. Each tubular member in the pluralities of tubular members 174 and 176 is coupled to one other tubular member when joining tubulars. The coupled tubular members 72 and 73 are part of the plurality of tubular members 174.

In operation, in an exemplary embodiment with continuing reference to FIGS. 16 and 17, the apparatus 148 is employed to assemble a string of drill pipe or casing as part of, e.g., oil and gas exploration and production operations. More particularly, at least one tubular member is temporarily coupled to the top drive 26, which operates to couple that tubular member to another tubular member which already extends within the wellbore 16 or is vertically positioned between the wellbore 16 and the tubular member coupled to the top drive 26; this other tubular member may be part of a string of drill pipe or casing.

As shown in FIGS. 16 and 17, the coupled tubular members 72 and 73 are supported by the support pedestal 162. The arm 154 moves downward along the vertically-extending support member 152 and thus along the axis 156. Before, during or after this downward movement, the arm 154 pivots about the axis 156 in a clockwise direction 179, as viewed in FIG. 17. Before, during or after this pivoting, the gripper 158 and thus the axis 160 move away from the axis 156 in the direction 78. In an exemplary embodiment, to move the gripper 158 and thus the axis 160 in the direction 78, each of the segments 154*b* and 154*c* may pivot about the pivot connections 154*d* and/or 154*e*. In an exemplary embodiment, to move the gripper 158 and thus the axis 160 in the direction 78, as viewed in FIG. 16, the segment 154*b* pivots in a clockwise direction, and the segment 154*c* pivots in a counterclockwise direction.

Before, during or after the movement of the gripper 158 in the direction 78, the gripper 158 rotates about the axis 160, relative to the arm 154, so that the gripper 158 extends horizontally, perpendicular to the vertically-extending support member 152. The gripper 158 engages the tubular member 73. In an exemplary embodiment, the gripper 158 engages the tubular member 73 by gripping the tubular member 73. The arm 154 then moves upward along the vertically-extending support member 152 and thus the axis 156, lifting the coupled tubular members 172 and 173 upward. During this lifting, as viewed in FIG. 16, the segment 154*b* pivots in a counterclockwise direction, and the segment 154*c* pivots in a clockwise direction, thereby moving the gripper 158 and thus the axis 160 and the coupled tubular members 72 and 73 towards the axis 156 in a direction 178, which is opposite the direction 78. Moreover, the gripper 158 rotates about the axis 160, relative to the arm 154, so that the gripper 158 and thus the coupled tubular members 72 and 73 extend vertically.

After the coupled tubular members 72 and 73 extend vertically and have been lifted high enough to clear the rig floor 14, the arm 154 pivots about the axis 156, pivoting the coupled tubular members 72 and 73 in a counterclockwise direction as viewed in FIG. 17. This pivoting continues until the coupled tubular members 72 and 73 are aligned with the axis 86 and are positioned underneath the top drive 26. As necessary, the carriage 24 and thus the top drive 26 move along the axis 20 and relative to the tower 18 so that the top drive 26 is at a position along the axis 20 at which the tubular member 72 can be coupled to the top drive 26. The tubular member 72 is then coupled to the top drive 26. During or after the coupling of the top drive 26 to the tubular member 72, the gripper 158 disengages from, or otherwise releases, the tubular member 73. The arm 154 then pivots about the axis 156 in the clockwise direction 179, as viewed in FIG. 17, so that the arm 154 is no longer underneath the top drive 26. The top drive 26 then lowers the tubular members 72 and 73 through the opening 84 and towards the wellbore 16. Before, during or after the lowering of the tubular members 72 and 73, the top drive 26 operates to couple the tubular member 73 to another tubular member either extending in the wellbore 16 or being vertically positioned between the wellbore 16 and the tubular member 73; this other tubular member may be part of a string of drill pipe or casing.

In an exemplary embodiment, before, during or after the coupling of the top drive 26 to the tubular member 72 and the subsequent lowering of the tubular members 72 and 73, the arm 166 pivots about the axis 173 in a counterclockwise direction, as viewed in FIG. 17. The gripper 168 and thus the axis 171 move away from the axis 173 in the direction 78. Before, during or after the movement of the gripper 168 and the axis 171 in the direction 78, the gripper 168 rotates, about the axis 171 and relative to the arm 166, so that the gripper 168 extends horizontally, perpendicular to the axis 173. The gripper 168 engages a tubular member 180, which is coupled to a tubular member 182 and is supported by the support pedestal 170. The tubular members 180 and 182 are part of the plurality of tubular members 176. The arm 166 then moves upward along the vertically-extending support member 164 and thus the axis 173, lifting the coupled tubular members 180 and 182. During this lifting, the gripper 168 and thus the axis 171 and the coupled tubular members 180 and 182 move in the direction 178 towards the vertically-extending support member 164 and thus the axis 173. The gripper 168 moves in the direction 178 in the same manner by which the gripper 158 moves in the direction 178 towards the vertically-extending support member 152. Additionally, during the lifting of the coupled tubular members 180 and 182, the gripper 168 rotates about the axis 171, relative to the arm 166, so that the gripper 168 and thus the coupled tubular members 180 and 182 extend vertically.

After the coupled tubular members 180 and 182 extend vertically and have been lifted high enough to clear the rig floor 14, the arm 166 pivots about the axis 173, pivoting the coupled tubular members 180 and 182 in a clockwise direction as viewed in FIG. 17. This pivoting continues until the coupled tubular members 180 and 182 are aligned with the axis 86 and are positioned underneath the top drive 26. As necessary, the carriage 24 and thus the top drive 26 move along the axis 20 and relative to the tower 18 so that the top drive 26 is at a position along the axis 20 at which the tubular member 182 can be coupled to the top drive 26. The tubular member 182 is then coupled to the top drive 26. During or after the coupling of the top drive 26 to the tubular member 182, the gripper 168 disengages from, or otherwise releases, the tubular member 180. The arm 166 then pivots about the axis 173 in a counterclockwise direction, as viewed in FIG. 17, so that the arm 166 is no longer underneath the top drive 26. The top drive 26 then lowers the tubular members 180 and 182 through the opening 84 and towards the wellbore 16. Before, during or after the lowering of the tubular members 180 and 182, the top drive 26 operates to couple the tubular member 180 to the tubular member 72. Before, during or after the coupling of the top drive 26 to the tubular member 182, the above-described operation of the arm 154 is repeated for another pair of coupled tubular members from the plurality of tubular members 174, which are subsequently coupled to the tubular member 182. In several exemplary embodiments, the above-described tandem, or alternating, operation of the arms 154 and 166 is repeated to continue to assemble the string of drill pipe or casing, of which the tubular members 72, 73, 180 and 182 are a part.

In view of all of the above and the figures, one of ordinary skill in the art will readily recognize that the present disclosure introduces an apparatus including a base; and a drilling tower pivotally coupled to the base to pivot the drilling tower between first and second pivot positions, the drilling tower including a first portion; and a second portion pivotally coupled to the first portion to pivot the second portion between third and fourth pivot positions when the drilling tower is in the first pivot position. According to one aspect, the second portion pivots from the third pivot position to the fourth pivot position in a second pivot direction; and wherein the drilling tower pivots from the first pivot position to the second pivot position in a second pivot direction opposite the first pivot direction. According to another aspect, the apparatus includes a telescoping member extending between the base and the first portion. According to yet another aspect, the apparatus includes a top drive coupled to the drilling tower and movable along each of the first and second portions of the drilling tower when the second portion is in the fourth pivot position. According to still yet another aspect, the apparatus includes a carriage to which the top drive is coupled, wherein the carriage is movably coupled to the drilling tower; and a linking member that is coupled to each of the carriage and the top drive and that pivots between fifth and sixth pivot positions; wherein the top drive defines a first axis; wherein a first spacing is defined between the first axis and the first portion of the drilling tower when the linking member is in the fifth pivot position; wherein a second spacing is defined between the first axis and the first portion of the drilling tower when the linking member is in the sixth pivot position; and wherein the second spacing is greater than the first spacing. According to still yet another aspect, the apparatus includes a first electric motor coupled to the top drive and movable therewith to move the top drive along each of the first and second portions of the drilling tower when the second portion is in the fourth pivot position. According to still yet another aspect, the drilling tower includes a first rack; and wherein the apparatus further includes a first pinion operably coupled to the first electric motor and engaged with the first rack to move the top drive along each of the first and second portions of the drilling tower when the second portion is in the fourth pivot position. According to still yet another aspect, the drilling tower further includes a second rack spaced from the first rack in a parallel relation; and wherein the apparatus further includes a second electric motor coupled to the top drive and movable therewith to move the top drive along each of the first and second portions of the drilling tower when the second portion is in the fourth pivot position; and a second pinion operably coupled to the second electric motor and engaged with the second rack to move the top drive along each of the first and second portions of the drilling tower when the second portion is in the fourth pivot position. According to still yet another aspect, the apparatus includes a carriage to which each of the top drive and the first and second electric motors is coupled. According to still yet another aspect, the drilling tower extends longitudinally along a first axis; wherein the first and second electric motors are spaced from each other in a direction that is perpendicular to the first axis; and wherein the first and second pinions are spaced from each other in the direction. According to still yet another aspect, the drilling tower extends longitudinally along a first axis; wherein the first and second electric motors are spaced from each other in a first direction that is parallel to the first axis; wherein the first and second pinions are spaced from each other in the first direction and in a second direction that is perpendicular to the first axis; and wherein the apparatus further includes third and fourth pinions engaged with the first and second racks, respectively, wherein the third and fourth pinions are spaced from each other in each of the first and second directions. According to still yet another aspect, the apparatus includes the drilling tower extends longitudinally along a first axis; wherein the apparatus further includes a carriage coupled to the drilling tower; and a linking member pivotally coupled to the carriage to permit the linking member to pivot between fifth and sixth pivot positions about a second axis that is perpendicular to the first axis; and wherein the top drive extends longitudinally in a parallel relation to the drilling tower, and is pivotally coupled to the linking member to permit the top drive to continue to extend longitudinally in a parallel relation to the drilling tower when the linking member pivots between the first and second pivot positions. According to still yet another aspect, the top drive is spaced from the drilling tower by first and second spacings when the linking member is in the fifth and sixth pivot positions, respectively, the first and second spacings extending in a direction that is perpendicular to the first axis; and wherein the second spacing is greater than the first spacing. According to still yet another aspect, the apparatus includes a platform; and a first opening formed in the platform and adapted to be disposed above a wellbore, the first opening defining a third axis that is spaced in a parallel relation from the first axis by the first spacing. According to still yet another aspect, the apparatus includes a second opening formed in the platform and adapted to receive a tubular member, the second opening defining a fourth axis that is spaced in a parallel relation from the first axis by the second spacing. According to still yet another aspect, the apparatus includes at least one actuator coupled to the carriage and the linking member to pivot the linking member between the first and second pivot positions. According to still yet another aspect, the drilling tower extends longitudinally along a first axis when the drilling tower is in the second pivot position; and wherein the apparatus further includes a tubular handling device to position one or more tubular members proximate the drilling tower, the tubular handling device including a first gripper to engage a first tubular member; and a first arm coupled to the first gripper, the first arm defining a second axis that is parallel to the first axis and spaced therefrom in a first direction, the first arm being movable along, and pivotable about, the second axis; and a third axis that is perpendicular to the second axis, the third axis being movable from the second axis in the first direction and movable to the second axis in a second direction opposite the first direction, the first gripper being rotatable, relative to the first arm, about the third axis.

The present disclosure also introduces a method including providing a base; and pivotally coupling a drilling tower to a base, which includes providing a first portion of the drilling tower; pivotally coupling a second portion of the drilling tower to the first portion of the drilling tower; and pivotally coupling the first portion of the drilling tower to the base. According to one aspect, the method includes pivoting the second portion of the drilling tower between first and second pivot positions; and pivoting the drilling tower between third and fourth positions. According to another aspect, the second portion pivots from the first pivot position to the second pivot position in a first pivot direction; and wherein the drilling tower pivots from the third pivot position to the fourth pivot position in a second pivot direction opposite the first pivot direction. According to yet another aspect, the method includes coupling a top drive to the drilling tower; and moving the top drive along each of the first and second portions of the drilling tower when the second portion is in the second pivot position and the drilling tower is in the fourth pivot position. According to still yet another aspect, the method includes pivotally coupling a linking member to each of the first portion and the top drive; and pivoting the linking member between fifth and sixth pivot positions; wherein the top drive defines a first axis; wherein a first spacing is defined between the first axis and the first portion of the drilling tower when the linking member is in the fifth pivot position; wherein a second spacing is defined between the first axis and the first portion of the drilling tower when the linking member is in the sixth pivot position; and wherein the second spacing is greater than the first spacing. According to still yet another aspect, the method includes coupling a first electric motor to the top drive; and employing at least the first electric motor to move at least the top drive and the first electric motor along each of the first and second portions of the drilling tower when the second portion is in the fourth pivot position. According to still yet another aspect, the drilling tower includes a first rack; and wherein the method further includes operably coupling a first pinion to the first electric motor; and engaging the first pinion with the first rack. According to still yet another aspect, the drilling tower further includes a second rack spaced from the first rack in a parallel relation; wherein the method further includes coupling a second electric motor to the top drive; operably coupling a second pinion to the second electric motor; and engaging the second pinion with the second rack; and wherein employing at least the first electric motor to move at least the top drive and the first electric motor along each of the first and second portions of the drilling tower when the second portion is in the fourth pivot position includes employing at least the first and second electric motors to move at least the top drive, the first electric motor, and the second electric motor, along each of the first and second portions of the drilling tower when the second portion is in the fourth pivot position. According to still yet another aspect, the method includes coupling a carriage to the top drive and the first and second electric motors. According to still yet another aspect, the drilling tower extends longitudinally along a first axis; wherein the first and second electric motors are spaced from each other in a direction that is perpendicular to the first axis; and wherein the first and second pinions are spaced from each other in the direction. According to still yet another aspect, the drilling tower extends longitudinally along a first axis; wherein the first and second electric motors are spaced from each other in a first direction that is parallel to the first axis; wherein the first and second pinions are spaced from each other in the first direction and in a second direction that is perpendicular to the first axis; and wherein the method further includes third and fourth pinions engaged with the first and second racks, respectively, wherein the third and fourth pinions are spaced from each other in each of the first and second directions. According to still yet another aspect, the drilling tower extends longitudinally along a first axis; and wherein the method further includes coupling a carriage to the drilling tower; pivotally coupling a linking member to the carriage to permit the linking member to pivot between fifth and sixth pivot positions about a second axis that is perpendicular to the first axis; and pivotally coupling the top drive to the linking member so that the top drive extends longitudinally in a parallel relation to the drilling tower, the top drive being pivotally coupled to the linking member to permit the top drive to continue to extend longitudinally in a parallel relation to the drilling tower when the linking member pivots between the fifth and sixth pivot positions. According to still yet another aspect, the method includes the top drive is spaced from the drilling tower by first and second spacings when the linking member is in the fifth and sixth pivot positions, respectively, the first and second spacings extending in a direction that is perpendicular to the first axis; and wherein the second spacing is greater than the first spacing. According to still yet another aspect, the method includes providing a platform; wherein a first opening is formed in the platform and is adapted to be disposed above a wellbore, the first opening defining a third axis that is spaced in a parallel relation from the first axis by the first spacing. According to still yet another aspect, a second opening is formed in the platform and is adapted to receive a tubular member, the second opening defining a fourth axis that is spaced in a parallel relation from the first axis by the second spacing. According to still yet another aspect, the method includes coupling at least one actuator to the carriage and the linking member to pivot the linking member between the fifth and sixth pivot positions. According to still yet another aspect, the drilling tower extends longitudinally along a first axis when the drilling tower is in the fourth pivot position; and wherein the method further includes employing a tubular handling device to position one or more tubular members proximate the drilling tower, including providing a first gripper; coupling a first arm to the first gripper, the first arm defining a second axis that is parallel to the first axis and spaced therefrom in a first direction, and a third axis that is perpendicular to the second axis; moving the first arm along the second axis; pivoting the first arm about the second axis; moving the third axis from the second axis in the first direction; rotating the first gripper, relative to the first arm, about the third axis; engaging a first tubular member with the first gripper; and moving the third axis, the first gripper and the first tubular member towards the second axis in a second direction opposite the first direction.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. §112, paragraph 6 for any limitations of any of the claims herein, except for those in which the claim expressly uses the word "means" together with an associated function.

The invention claimed is:

1. An apparatus, comprising:

a base; and a drilling tower pivotally coupled to the base to pivot the drilling tower between a first pivot position that is associated with a generally horizontal orientation and a second pivot position that is associated with a generally vertical orientation, the drilling tower comprising:

a first portion;

a second portion pivotally coupled to the first portion to pivot the second portion, relative to the first portion, between a folded position and an extended position while the drilling tower is in the first pivot position; and a top drive coupled to the drilling tower and movable along each of the first and second portions of the drilling tower while the second portion is in the extended position.

2. The apparatus of claim 1 wherein the second portion pivots from the folded position to the extended position in a first pivot direction; and wherein the drilling tower pivots from the first pivot position to the second pivot position in a second pivot direction opposite the first pivot direction.

3. The apparatus of claim 1 further comprising a telescoping member extending between the base and the first portion.

4. The apparatus of claim 1 further comprising:

a carriage to which the top drive is coupled, wherein the carriage is movably coupled to the drilling tower; and a linking member that is coupled to each of the carriage and the top drive and that pivots between third and fourth pivot positions;

wherein the top drive defines a first axis;

wherein a first spacing is defined between the first axis and the first portion of the drilling tower while the linking member is in the third pivot position;

wherein a second spacing is defined between the first axis and the first portion of the drilling tower while the linking member is in the fourth pivot position; and wherein the second spacing is greater than the first spacing.

5. The apparatus of claim 1 wherein the drilling tower extends longitudinally along a first axis;

wherein the apparatus further comprises:

a carriage coupled to the drilling tower; and a linking member pivotally coupled to the carriage to permit the linking member to pivot between third and fourth pivot positions about a second axis that is perpendicular to the first axis; and wherein the top drive extends longitudinally in a parallel relation to the drilling tower, and is pivotally coupled to the linking member to permit the top drive to continue to extend longitudinally in a parallel relation to the drilling tower while the linking member pivots between the first and second pivot positions.

6. The apparatus of claim 5 wherein the top drive is spaced from the drilling tower by first and second spacings while the linking member is in the third and fourth pivot positions, respectively, the first and second spacings extending in a direction that is perpendicular to the first axis; and wherein the second spacing is greater than the first spacing.

7. The apparatus of claim 6 further comprising:

a platform; and a first opening formed in the platform and adapted to be disposed above a wellbore, the first opening defining a third axis that is spaced in a parallel relation from the first axis by the first spacing.

8. The apparatus of claim 7 further comprising a second opening formed in the platform and adapted to receive a tubular member, the second opening defining a fourth axis that is spaced in a parallel relation from the first axis by the second spacing.

9. The apparatus of claim 5 further comprising:

at least one actuator coupled to the carriage and the linking member to pivot the linking member between the first and second pivot positions.

10. The apparatus of claim 1 wherein the drilling tower extends longitudinally along a first axis while the drilling tower is in the second pivot position; and wherein the apparatus further comprises a tubular handling device to position one or more tubular members proximate the drilling tower, the tubular handling device comprising:

a first gripper to engage a first tubular member; and a first arm coupled to the first gripper, the first arm defining:

a second axis that is parallel to the first axis and spaced therefrom in a first direction, the first arm being movable along, and pivotable about, the second axis; and a third axis that is perpendicular to the second axis, the third axis being movable from the second axis in the first direction and movable to the second axis in a second direction opposite the first direction, the first gripper being rotatable, relative to the first arm, about the third axis.

11. A method, comprising:

providing a base; and pivotally coupling a drilling tower to a base, which comprises:

providing a first portion of the drilling tower;

pivotally coupling a second portion of the drilling tower to the first portion of the drilling tower; and pivotally coupling the first portion of the drilling tower to the base;

pivoting the drilling tower between a first pivot position that is associated with a generally horizontal orientation and a second pivot position that is associated with a generally vertical orientation; and pivoting, relative to the first portion of the drilling tower, the second portion of the drilling tower between a folded position and an extended position while the drilling tower is in the first pivot position;

wherein the second portion of the drilling tower pivots from the folded position to the extended position in a first pivot direction; and wherein the drilling tower pivots from the first pivot position to the second pivot position in a second pivot direction opposite the first pivot direction.

12. The method of claim 11 further comprising:

coupling a top drive to the drilling tower; and moving the top drive along each of the first and second portions of the drilling tower when the second portion is in the extended position and the drilling tower is in the second pivot position.

13. The method of claim 12 wherein the drilling tower extends longitudinally along a first axis; and wherein the method further comprises:

coupling a carriage to the drilling tower;

pivotally coupling a linking member to the carriage to permit the linking member to pivot between third and fourth pivot positions about a second axis that is perpendicular to the first axis; and pivotally coupling the top drive to the linking member so that the top drive extends longitudinally in a parallel relation to the drilling tower, the top drive being pivotally coupled to the linking member to permit the top drive to continue to extend longitudinally in a parallel relation to the drilling tower while the linking member pivots between the third and fourth pivot positions.

14. The method of claim 13 wherein the top drive is spaced from the drilling tower by first and second spacings while the linking member is in the third and fourth pivot positions, respectively, the first and second spacings extending in a direction that is perpendicular to the first axis; and wherein the second spacing is greater than the first spacing.

15. The method of claim 14 further comprising:

providing a platform;

wherein a first opening is formed in the platform and is adapted to be disposed above a wellbore, the first opening defining a third axis that is spaced in a parallel relation from the first axis by the first spacing.

16. The method of claim 15 wherein a second opening is formed in the platform and is adapted to receive a tubular member, the second opening defining a fourth axis that is spaced in a parallel relation from the first axis by the second spacing.

17. The method of claim 12 wherein the drilling tower extends longitudinally along a first axis while the drilling tower is in the second pivot position; and wherein the method further comprises:

employing a tubular handling device to position one or more tubular members proximate the drilling tower, comprising:

providing a first gripper;

coupling a first arm to the first gripper, the first arm defining:

a second axis that is parallel to the first axis and spaced therefrom in a first direction, and a third axis that is perpendicular to the second axis;

moving the first arm along the second axis;

pivoting the first arm about the second axis;

moving the third axis from the second axis in the first direction;

rotating the first gripper, relative to the first arm, about the third axis;

engaging a first tubular member with the first gripper; and moving the third axis, the first gripper and the first tubular member towards the second axis in a second direction opposite the first direction.

18. The method of claim 13 further comprising:

coupling at least one actuator to the carriage and the linking member to pivot the linking member between the third and fourth pivot positions.

19. The method of claim 12 further comprising:

pivotally coupling a linking member to each of the first portion and the top drive; and pivoting the linking member between third and fourth pivot positions;

wherein the top drive defines a first axis;

wherein a first spacing is defined between the first axis and the first portion of the drilling tower while the linking member is in the third pivot position;

wherein a second spacing is defined between the first axis and the first portion of the drilling tower while the linking member is in the fourth pivot position; and wherein the second spacing is greater than the first spacing.

* * * * *